US008337172B2

(12) United States Patent
Klika et al.

(10) Patent No.: US 8,337,172 B2
(45) Date of Patent: Dec. 25, 2012

(54) PRESSURE WASHER PUMP AND ENGINE SYSTEM

(75) Inventors: Daniel L. Klika, Waukesha, WI (US); David A. Kratz, Brookfield, WI (US); Gary J. Gracyalny, Elm Grove, WI (US); David Procknow, Elm Grove, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 137 days.

(21) Appl. No.: 12/719,743

(22) Filed: Mar. 8, 2010

(65) Prior Publication Data

US 2011/0081261 A1 Apr. 7, 2011

Related U.S. Application Data

(63) Continuation-in-part of application No. 12/573,818, filed on Oct. 5, 2009.

(51) Int. Cl.
*F04B 35/04* (2006.01)
*F04B 39/06* (2006.01)
*F01P 5/10* (2006.01)

(52) U.S. Cl. ..... 417/364; 417/366; 123/41.47

(58) Field of Classification Search ..... 417/364, 417/366, 367, 373; 123/41.47
See application file for complete search history.

(56) References Cited

U.S. PATENT DOCUMENTS 2,044,849 A 6/1936 Himberger
2,102,861 A 12/1937 Melcher
2,554,191 A 5/1951 Huber
3,525,001 A 8/1970 Erickson
4,086,034 A 4/1978 Hokky
4,140,442 A 2/1979 Mulvey
4,155,333 A 5/1979 Maggiorana
4,198,935 A * 4/1980 Seibt et al. ..... 123/41.44
4,480,967 A 11/1984 Schulze
4,583,921 A 4/1986 Wolff et al.
4,643,652 A 2/1987 Eberhardt
4,756,280 A * 7/1988 Tamba et al. ..... 123/41.47
5,040,950 A 8/1991 Dalquist, III et al.
5,179,921 A 1/1993 Figliuzzi
5,338,162 A 8/1994 Krarup
5,415,134 A * 5/1995 Stewart, Jr. ..... 123/41.01
5,494,414 A * 2/1996 Steinhart et al. ..... 417/360
5,556,264 A 9/1996 Simonette (Continued)

OTHER PUBLICATIONS

Honda Marine, BF 35A/40A/50A Owner'S Manual, 1994, American Honda Motor Co., Inc., 111 pages.

(Continued)

*Primary Examiner* — Charles Freay
(74) *Attorney, Agent, or Firm* — Foley & Lardner LLP

(57) ABSTRACT

A pressure washer system includes an engine block, a water conduit, a water pump, and a spray gun. The engine block is for a horizontally-shafted internal combustion engine, and has a chamber therein. The chamber is designed to contain oil for cooling and lubricating the internal combustion engine. The water conduit has a garden hose connector on an end thereof, and is fastened to the engine block. As such, heat transfers from the engine block to a flow of water passing through the water conduit during operation of the internal combustion engine. The water pump is coupled to the water conduit, where the flow of water is driven by the water pump. The spray gun is coupled to the water pump, where the flow of water exits the pressure washer system via the spray gun.

22 Claims, 20 Drawing Sheets

U.S. PATENT DOCUMENTS

| | | | | |
|---|---|---|---|---|
| 5,785,505 | A | 7/1998 | Price | |
| 5,975,863 | A | 11/1999 | Mazzucato | |
| 5,980,220 | A | 11/1999 | Mazzucato et al. | |
| 6,092,998 | A | 7/2000 | Dexter et al. | |
| 6,109,221 | A | 8/2000 | Higgins et al. | |
| 6,146,222 | A | 11/2000 | Murata et al. | |
| 6,270,322 | B1 | 8/2001 | Hoyt | |
| 6,886,523 | B2 * | 5/2005 | Steffes et al. | 123/196 R |
| 2006/0102212 | A1 | 5/2006 | Leasure et al. | |
| 2006/0254539 | A1 | 11/2006 | Emmersberger | |
| 2011/0081261 | A1 | 4/2011 | Klika et al. | |

OTHER PUBLICATIONS

Honda Marine, Flush Kits, 06190-881-860, 06190-ZV1-860, 19270-ZW1-740, 1 page.

* cited by examiner

PRESSURE WASHER PUMP AND ENGINE SYSTEM

CROSS-REFERENCE TO RELATED APPLICATIONS

This application is a continuation-in-part of application Ser. No. 12/573,818, filed Oct. 5, 2009, which is incorporated herein by reference in its entirety.

BACKGROUND

The present invention relates generally to the field of internal combustion engines, such as those used to power pressure washers. More specifically, the present invention relates to an engine block and cover for such an engine.

A pressure washer includes a water pump powered by a small, internal combustion engine. The engine includes an engine block having internal chamber, such as a crankcase, in which a piston drives a crankshaft. The piston and crankshaft are lubricated by motor oil, and if the engine is a vertically-shafted engine, typically the oil pools in a cover (e.g., a sump) forming a base of the crankcase. The engine may be mounted to a base plate of a wheeled support frame. A power takeoff end of the crankshaft extends through an opening in the crankcase, and then through the base plate to engage the water pump.

The water pump typically includes a housing mounted to the underside of the base plate. Typically inlet and outlet pipes extend from the water pump beneath the base plate. To use the pressure washer, a garden hose is attached to the inlet pipe, and a pressure washer spray gun is coupled to a high-pressure hose line attached to the outlet pipe of the pump. Within the housing, the pump includes a pumping mechanism for driving the flow of water.

SUMMARY

One embodiment of the invention relates to a pressure washer system. The system includes an engine block, a water conduit, a water pump, and a spray gun. The engine block is for a horizontally-shafted internal combustion engine, and has a chamber therein. The chamber is designed to contain oil for cooling and lubricating the internal combustion engine. The water conduit has a garden hose connector on an end thereof, and is fastened to the engine block. As such, heat transfers from the engine block to a flow of water passing through the water conduit during operation of the internal combustion engine. The water pump is coupled to the water conduit, where the flow of water is driven by the water pump. The spray gun is coupled to the water pump, where the flow of water exits the pressure washer system via the spray gun.

Another embodiment of the invention relates to a pressure washer system. The pressure washer system includes an internal combustion engine, a water pump, and a water conduit. The internal combustion engine includes an engine block and a crankshaft. The engine block has a chamber in the engine block. The chamber is designed to contain a lubricant. The crankshaft is at least partially within the chamber. The water pump includes a pumping mechanism powered by the crankshaft. The water conduit extends through at least a portion of the chamber of the internal combustion engine such that material continuously extends between the interior of the chamber and a flow of water passing through the water conduit during operation of the pressure washer system. The water conduit directs a flow of water to the pumping mechanism, such that heat transfers from the lubricant to the water during operation of the pressure washer system.

Yet another embodiment of the invention relates to a pressure washer system. The pressure washer system includes an internal combustion engine and a water pump. The engine includes an engine block, a crankshaft, a water conduit, and a hose connector. The engine block has a crankcase designed to contain a lubricant. The crankshaft is at least partially within the crankcase. The water conduit extends through at least a portion of the crankcase such that material continuously extends between the interior of the crankcase and a flow of water passing through the water conduit during operation of the pressure washer system. The hose connector is attached to an end of the water conduit. The water pump includes a pumping mechanism powered by the crankshaft, and the water conduit directs a flow of water to the pumping mechanism.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
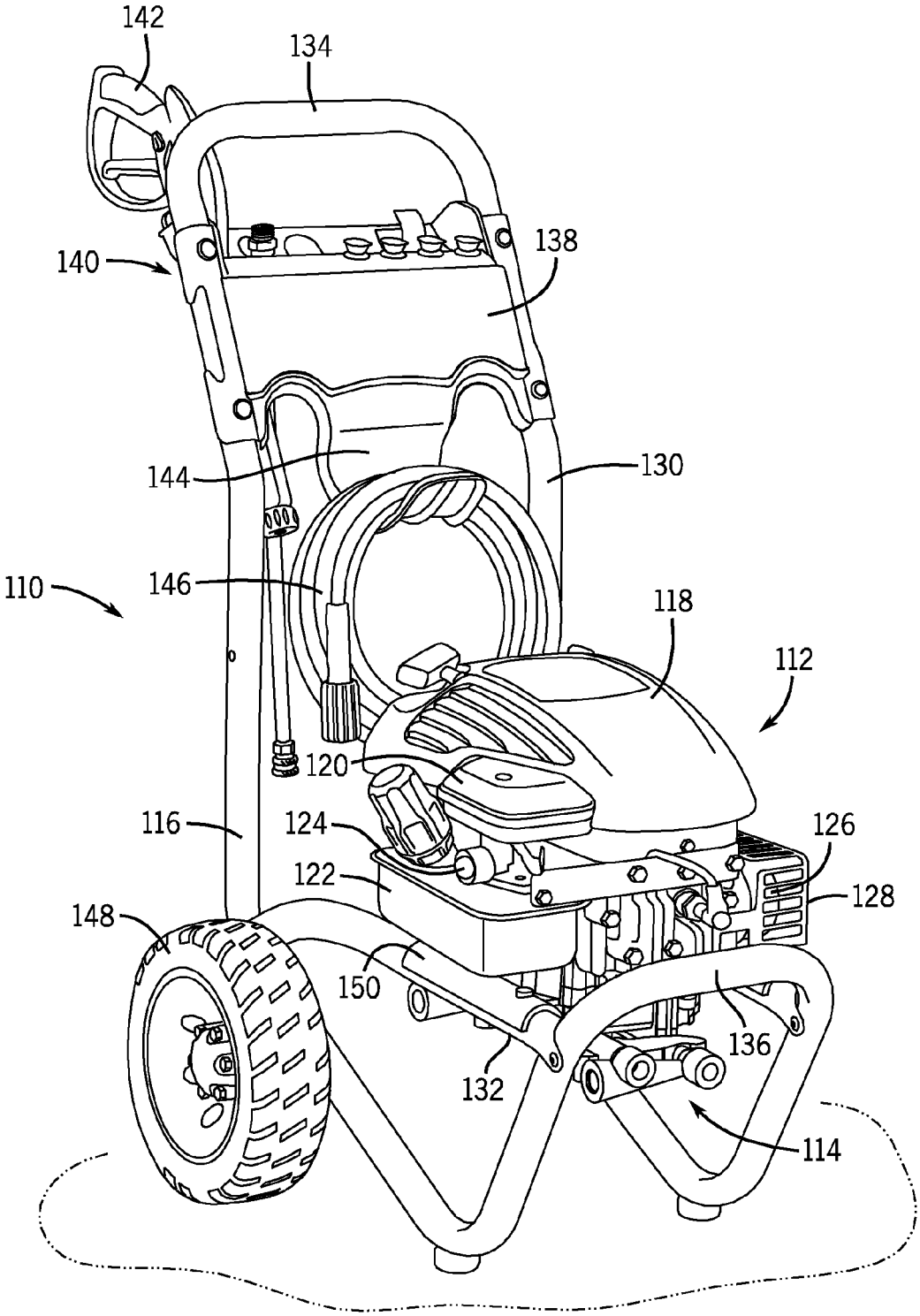
FIG. 1 is a perspective view of a pressure washer system according to an exemplary embodiment of the invention.

Referring to FIG. 1, a pressure washer system 110 includes an internal combustion engine 112, a high-pressure water pump 114, and a support frame 116. The engine includes an engine cover 118, an air intake 120, a fuel tank 122, a priming bulb 124, a muffler 126 surrounded by a cage 128, and other engine components. The engine 112 further includes a mounting structure in the form of attachment supports 150 (e.g., wings, sleeves, saddles, brackets, etc.) that extend from the engine. According to an exemplary embodiment, the engine 112 is a four cycle (four cycle meaning four piston strokes per cycle), vertically shafted, single-cylinder engine of a portable size and weight, and with a power sufficient to drive the high-pressure water pump 114. In some embodiments, the engine 112 is configured to provide 3 to 10 foot-pounds (ft-lbf) of torque at a rate of 3060 revolutions per minute (rpm). In another embodiment, the engine is configured to provide a power of 3 to 50 horsepower (HP). In other embodiments, the engine 112 may be a two-stroke engine, or may be horizontally shafted, or has more than one cylinder, or is diesel powered.

Figure 14:
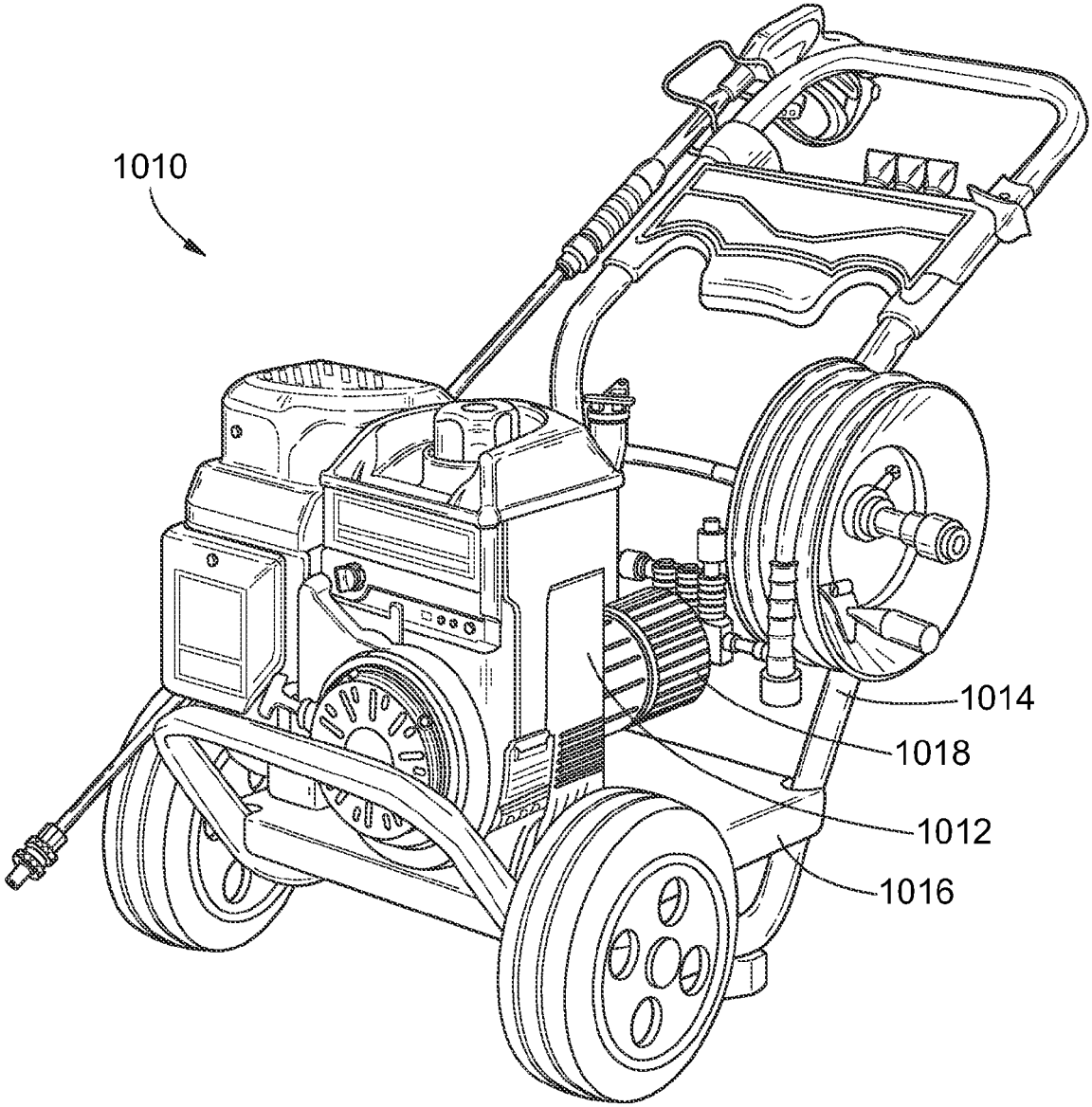
FIG. 14 is a perspective view of a pressure washer system according to another exemplary embodiment of the invention.
Figure 15:
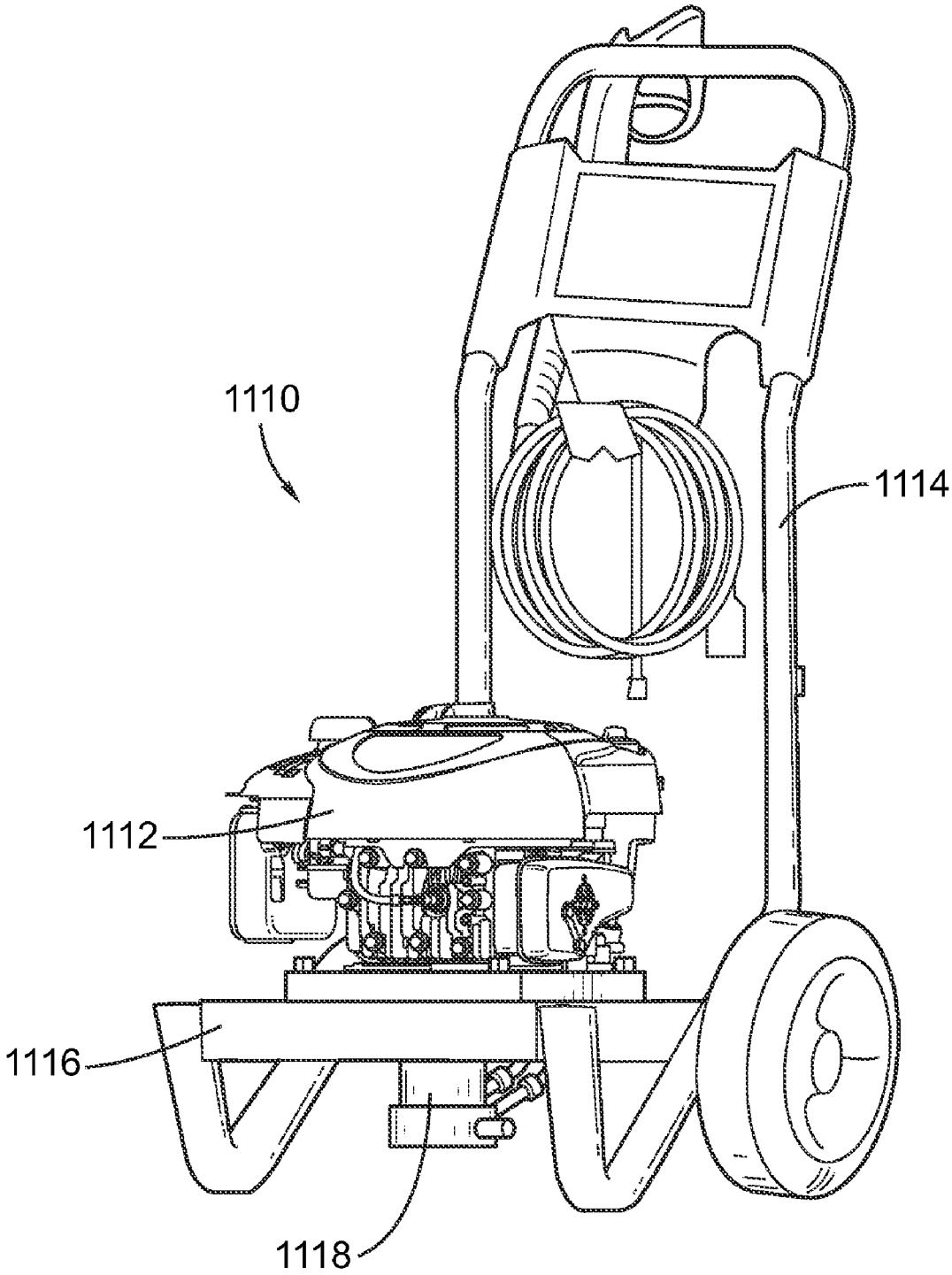
FIG. 15 is a perspective view of a pressure washer system according to yet another exemplary embodiment of the invention.

The engine 112 and the pump 114 are mounted on the support frame 116, which is formed from a network of tubular beams 130 with two beams 132 (e.g., rails, bars, tracks, etc.) upon which the engine 112 is fastened. The support frame additionally includes a handle 134, a front member 136, a billboard 138, a holster 140 for a pressure washer spray gun 142, a rack 144 for a high-pressure hose 146, wheels 148, and other features. The attachment supports 150 of the engine 112 are positioned on the beams 132 and are bolted or otherwise fastened to the frame 116. In other embodiments, a base plate is used in place of attachment supports 150 (see, e.g., base plate 1016 as shown in FIG. 14, and base plate 1116 as shown in FIG. 15). In still other embodiments, the support frame 116 includes casters, a protective housing or framework surrounding the engine 112, a drive system for powering the wheels 148, and other features.

Figure 2:
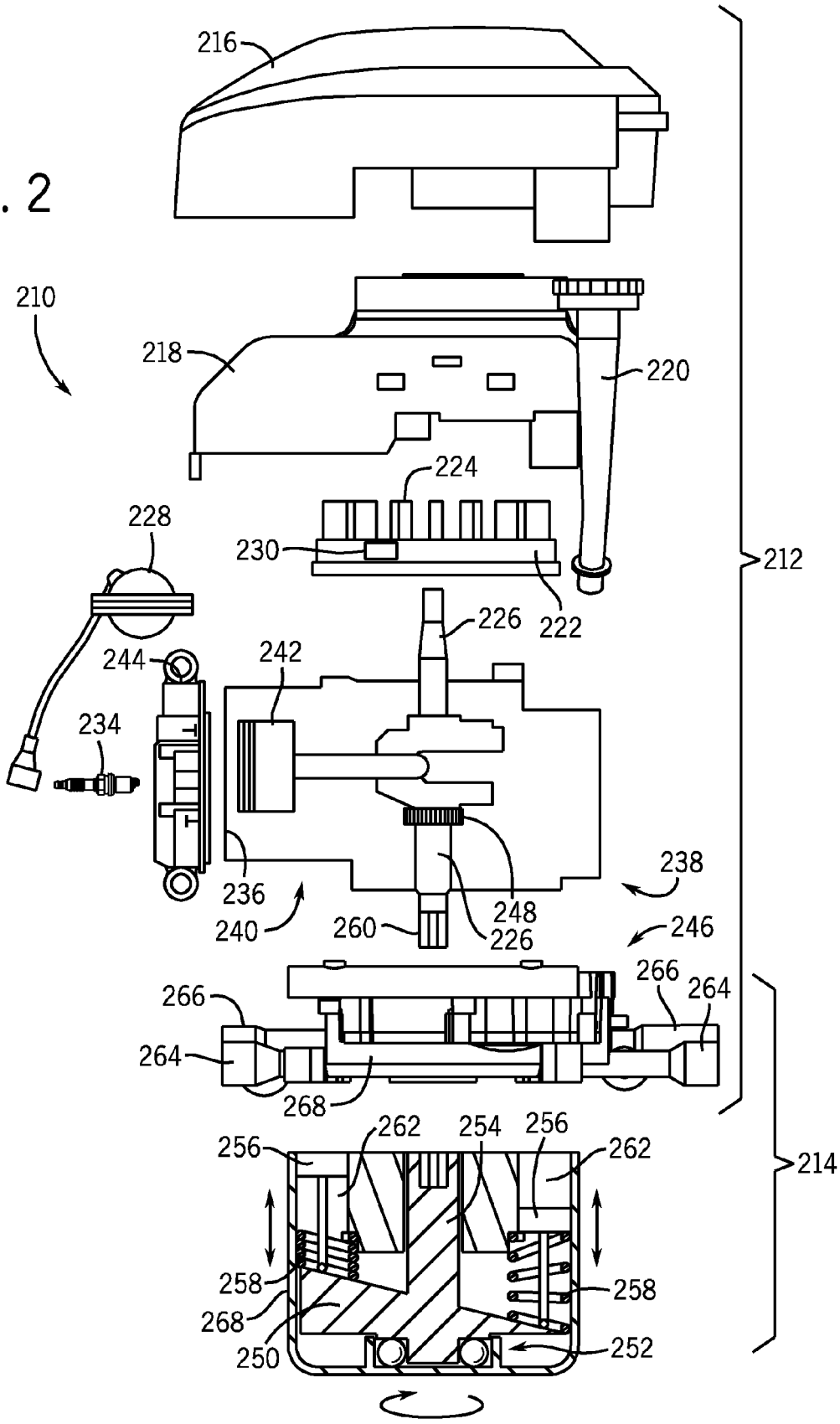
FIG. 2 is an exploded view of an engine and a water pump according to an exemplary embodiment of the invention.
Figure 3:
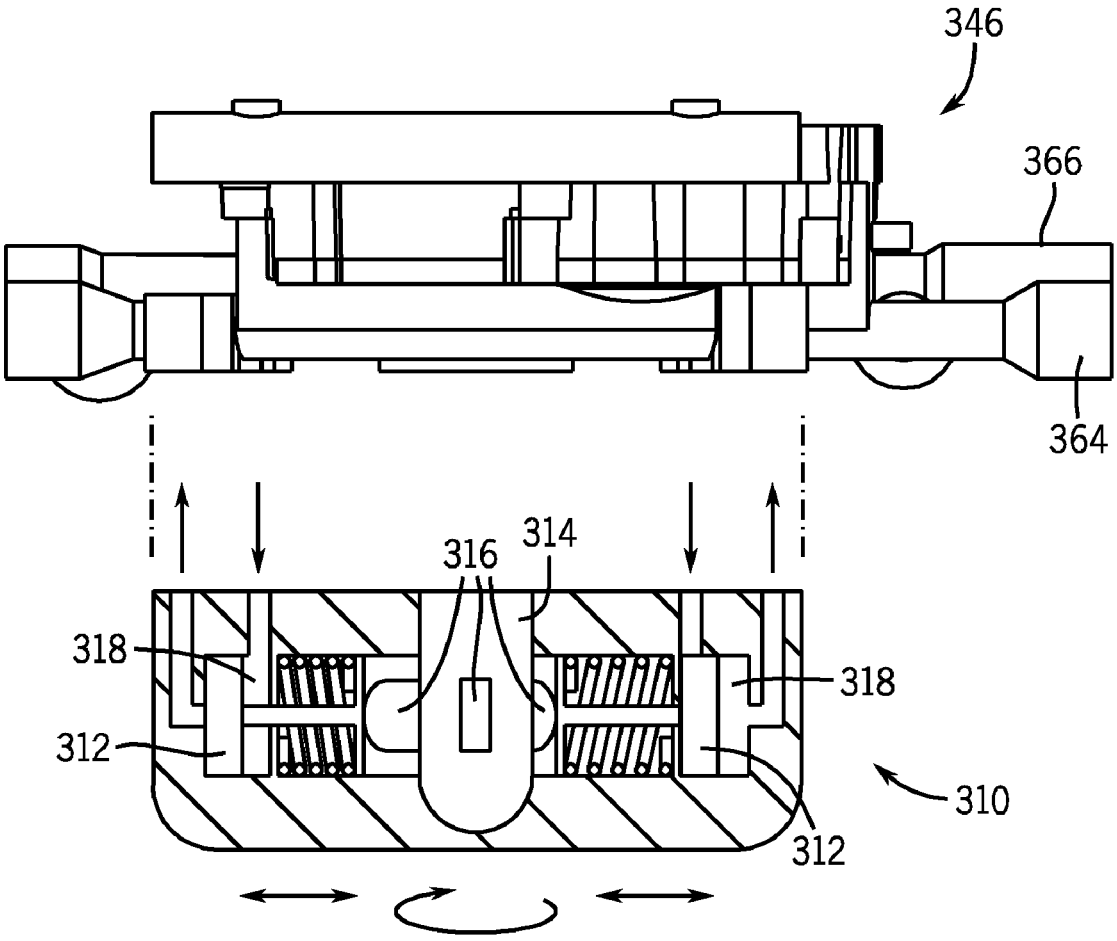
FIG. 3 is an exploded view of a portion of an engine and a water pump according to an exemplary embodiment of the invention.
Figure 4:
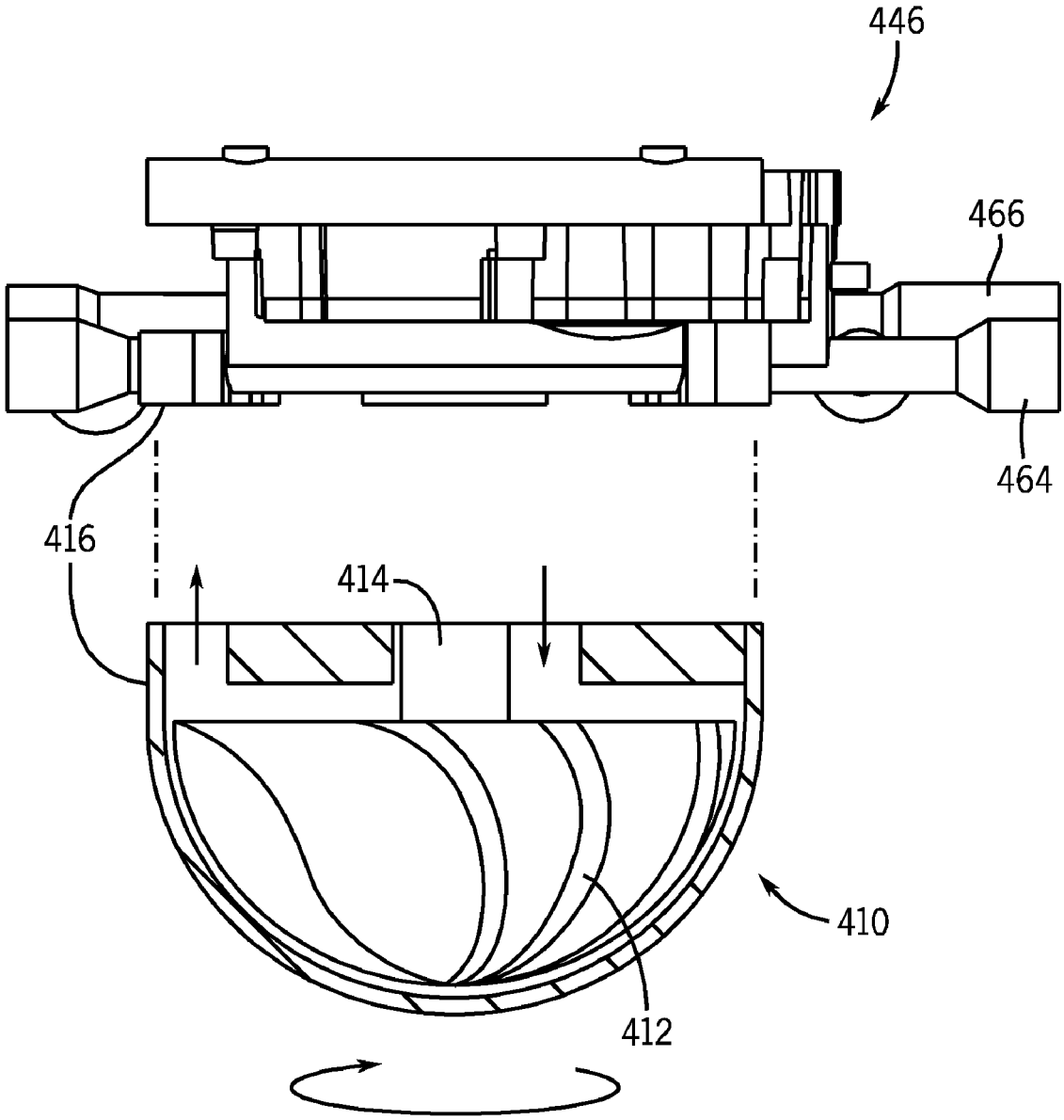
FIG. 4 is an exploded view of a portion of an engine and a water pump according to another exemplary embodiment of the invention.

The high-pressure water pump 114 may be a positive displacement pump, such as an axial cam pump (see, e.g., pump 214 as shown in FIG. 2), a duplex water pump with two pistons or plungers (see, e.g., pump 310 as shown in FIG. 3), a triplex water pump, a radial pump, or another type of positive displacement pump according to various embodiments. In operation, a high-pressure water stream is generated by the pump 114 and exits the pressure washer system 110 through the spray gun 142, or another form of sprayer. In some embodiments the pressure washer system is configured to generate a water stream having an exit pressure exceeding 1000 psi, preferably exceeding 2000 psi. In other embodiments, the water pump 114 is not a positive displacement pump. For example, in at least one embodiment, the pump 114 is a centrifugal water pump (see, e.g., pump 410 as shown in FIG. 4). In another embodiment, the pump 114 is an oil-less pump (e.g., similar to a pump disclosed in U.S. Pat. No. 6,397,729).

Referring to FIG. 2, a pressure washer system 210 includes an engine 212 and a pump 214. The engine 212 is assembled from several components, including a shroud 216 mounted over a blower housing 218 and an oil fill tube 220. Beneath the blower housing 218, the engine 212 includes a flywheel 222 with blower fan blades 224 extending from the flywheel 222. A crankshaft 226 rotates the flywheel 222, which stores rotational inertia and, via the blower fan blades 224, also generates an air flow to cool the engine 212. Additionally, an ignition armature 228 is mounted proximate to the flywheel 222 so that magnets 230 within the flywheel 222 pass by the ignition armature 228 at specifically timed intervals, generating a high-voltage charge once per rotation of the flywheel 222. The charge is directed to a sparkplug 234, which sparks to ignite a fuel and air mixture in a combustion chamber 236 of the engine 212.

Still referring to FIG. 2, the crankshaft 226 extends within a crankcase 238 (e.g., a chamber formed in a block of the engine). A cylinder 240 extends from the side of the crankcase 238, through which a piston 242 translates. A cylinder head 244 is mounted to an end of the cylinder 240, enclosing the combustion chamber 236. The piston 242 is driven by the specifically timed ignitions of fuel/air mixture in the combustion chamber 236 initiated by the sparkplug 234. Additionally, a cover 246 (e.g., a crankcase sump) is attached to the bottom of the crankcase 238. Oil (or other lubricant) forms a pool in the cover 246 and is then distributed throughout the crankcase 238 by a dipper, a slinger, a pump, moving components, or some other distribution device (not shown), which may be powered by the crankshaft 226. The crankshaft 226 includes gearing 248 that drives a camshaft (not shown) and other components of the engine 212.

Beneath the crankcase 238, the pump 214 is coupled to the engine 212 and includes a wobble plate 250, a bearing 252, a shaft 254, pistons 256, and springs 258 for biasing the pistons 256. A power takeoff 260, extending from the crankshaft 226, is coupled to the shaft 254 of the pump 214. The wobble plate 250 of the pump 214 is positioned below the pistons 256, in an inverted axial cam configuration. As the shaft 254 rotates, the wobble plate 250 drives the pistons 256. Each of the pistons 256 pulls water into a chamber 262 from an inlet conduit 264 (e.g., a first conduit, fluid passage, etc.) and then pushes the water, under pressure, from the chamber 262 to an outlet conduit 266 (e.g., a second conduit, fluid passage, etc.). The pistons 256 have a two-stroke cycle (i.e., intake on a downward stroke, and exit on an upward stroke). Check valves allow the water to pass by the pistons 256 on each downward stroke.

According to an exemplary embodiment, the cover 246 of the engine 212 is integrally formed with a part of a housing 268 of the pump 214. The underside of the cover 246 forms a top of the housing 268. The crankshaft 226 passes through an opening in cover 246 to drive the pump 214. In some embodiments, fluid passages, such as the inlet and outlet conduits 264, 266 of the pump 214, extend within the cover 246 and through the housing 268. In certain embodiments, the inlet and outlet conduits 264, 266 are integrally formed with and extend from the cover 246 and housing 268. Extending the inlet and outlet conduits 264, 266 from the top of the pump 214 provides for an elevated access point, which may be more convenient to a user of the system 210 relative to pumps with pipes extending from the bottom of the pumps.

Figure 7:
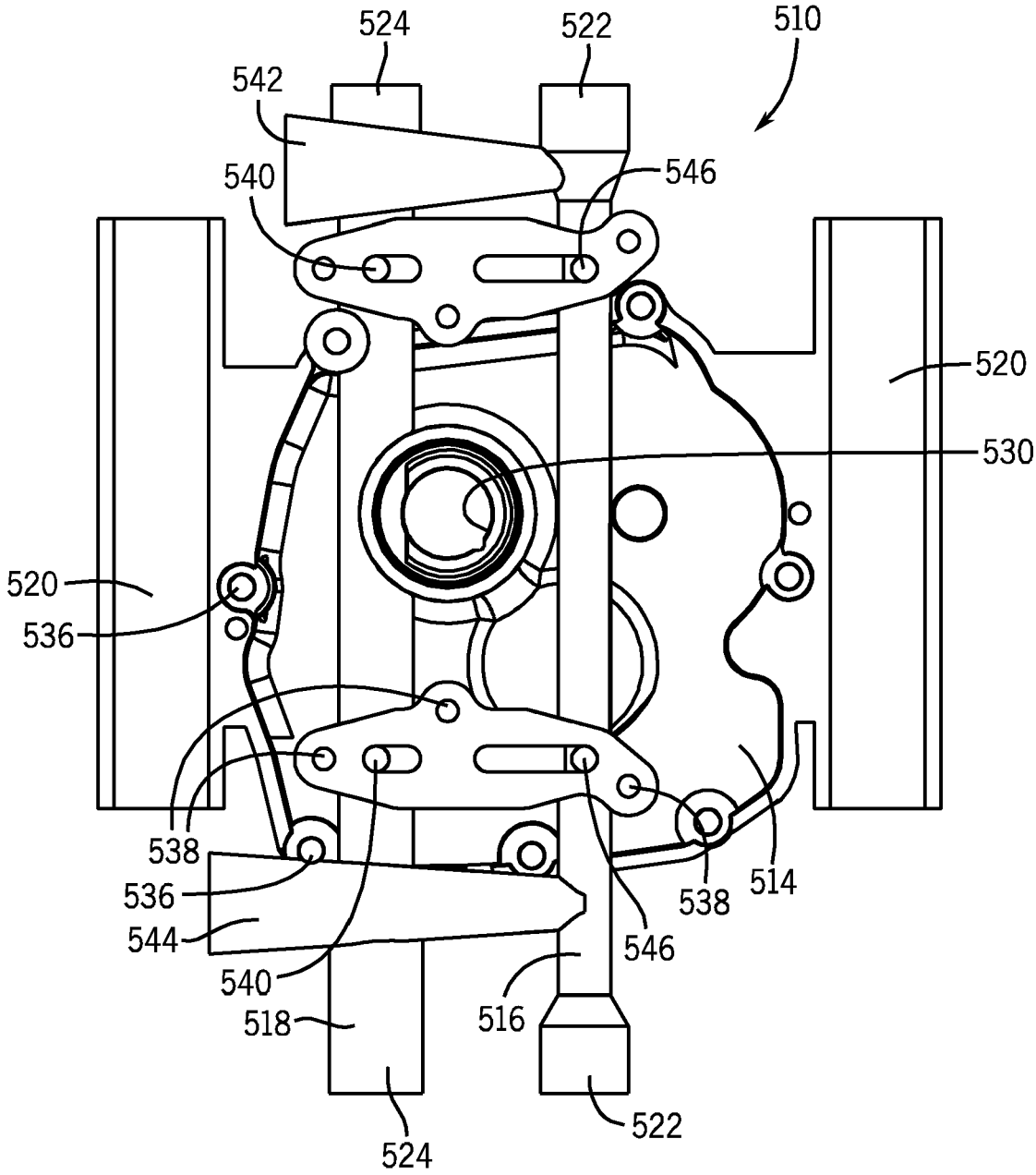
FIG. 7 is a bottom view of the portion of the engine of FIG. 5.

Plumbing within the pump 214 (and other pumps, such as pumps 310, 410, as shown in FIGS. 3-4) may be adjusted as necessary to match the plumbing of the cover 246 (and other covers, such as cover 346, 446). Also, for example, a mold for casting the cover 246 may be adjusted to reconfigure the plumbing in the cover 246 to be compatible with the plumbing of another particular pump. Openings (see, e.g., apertures 540, 546 as shown in FIG. 7) in the inlet and outlet conduits 264, 266, which allow water to flow to and from the pumping mechanism, may be positioned and sized to match inlet and outlet manifolds, pipes, and conduits in the particular pump. Depending upon the configuration of the particular pump, check valves may be added to the openings or the inlet and outlet conduits 264, 266 to control the flow of water. In some embodiments, when the pump 214 is mounted to the cover 246, beveled or threaded mouths of pump pipes may be inserted through openings in the inlet and outlet conduits 264, 266. Connection between the pump 214 and the inlet and outlet conduits 264, 266 may be fitted with rubber seals, liquid sealant, compression sealed, or otherwise sealed.

Water used by the pressure washer system 210 may flow from a source (e.g., faucet, tap, bibcock, spigot, etc.) that is not typically heated, providing the water at temperatures ranging between 40-80 degrees Fahrenheit (F). Conversely, during engine operation, heat is transferred from the engine to lubricant (e.g., motor oil) in the engine 212, and the lubricant may reach temperatures exceeding 200° F. As such, the water passing through the pump 214 is generally cooler than the lubricant in the engine. The structure shown in FIG. 2 provides for heat transfer from the engine oil through an interior surface of the conduits 264, 266 and into the water flowing through the pump 214. Accordingly the lubricant is cooled, which may reduce engine running temperatures, improve engine efficiency, and reduce heat-related engine wear.

Referring to FIG. 3, a cover 346 is fastened to a positive displacement pump 310 having a pumping mechanism that includes one, two, three, or more horizontally-arranged pistons 312 (e.g., commercially-available triplex and duplex pumps). The power takeoff 260 (see FIG. 2) of the engine crankshaft 226 may be coupled to a shaft 314 of the pump 310. The pistons 312 are then driven by cams 316 extending from the shaft 314. The pistons 312 of the pump 310 operate on a two-stroke cycle. Water enters a chamber 318 through a fluid passage behind one of the pistons 312 on a first forward stroke. The water then passes a check valve on a reverse stroke. Next the water is pushed out of the chamber 318 by the piston 312 on a second forward stroke. The pump 310 includes a fluid passage or more than one fluid passage. For example, water enters the pump 310 via an inlet conduit 364, passes along a flow path through the pumping mechanism, and exits the pump 310 via an outlet conduit 366.

Referring to FIG. 4, a cover 446 is fastened to a centrifugal pump 410 having a pumping mechanism that includes an impeller 412 (e.g., rotor) spinning about a central shaft 414 within a housing 416. The cover 446 forms the top of the housing 416. According to an exemplary embodiment, the shaft 414 is powered by the engine 212. An inlet conduit 464 directs water through the cover 446 and into the pump 410. The inlet conduit 464 includes a fluid passage that directs the water near the center of the impeller 412. The impeller 412 flings the water to the outside of the housing 416, increasing the water pressure. An outlet conduit 466 connects to the pump 410 via a fluid passage positioned near the outside of the impeller 412.

According to an exemplary embodiment, the outlet conduit 446 directs the pressurized water out of the pump 410, through the cover 446, and to the pressure washer sprayer (e.g., spray gun 142 as shown in FIG. 1).

Referring now to FIGS. 5-8, a body 510 (e.g., a portion of an engine crankcase, a top of a pump housing, etc.) includes a base 512 of an engine block (e.g., crankcase 238 as shown in FIG. 2), a top 514 of a pump housing (e.g., pump housing 268 as shown in FIG. 2), attachment supports 520, and fluid passages, such as an inlet pipe 516 and an outlet pipe 518. According to an exemplary embodiment, the body 510 is integrally formed (e.g., a single, unitary body), such as by casting, molding, welding, or other forming methods. In another embodiment, the body 510 is formed from components that are not integral, but are fastened together, such as a top of a pump housing bolted to a base of a crankcase forming a combined body. The body 510 may be formed from discrete parts or a continuous, solid material, such as aluminum, steel, cast iron, ceramic, composite, or other materials.

Figure 5:
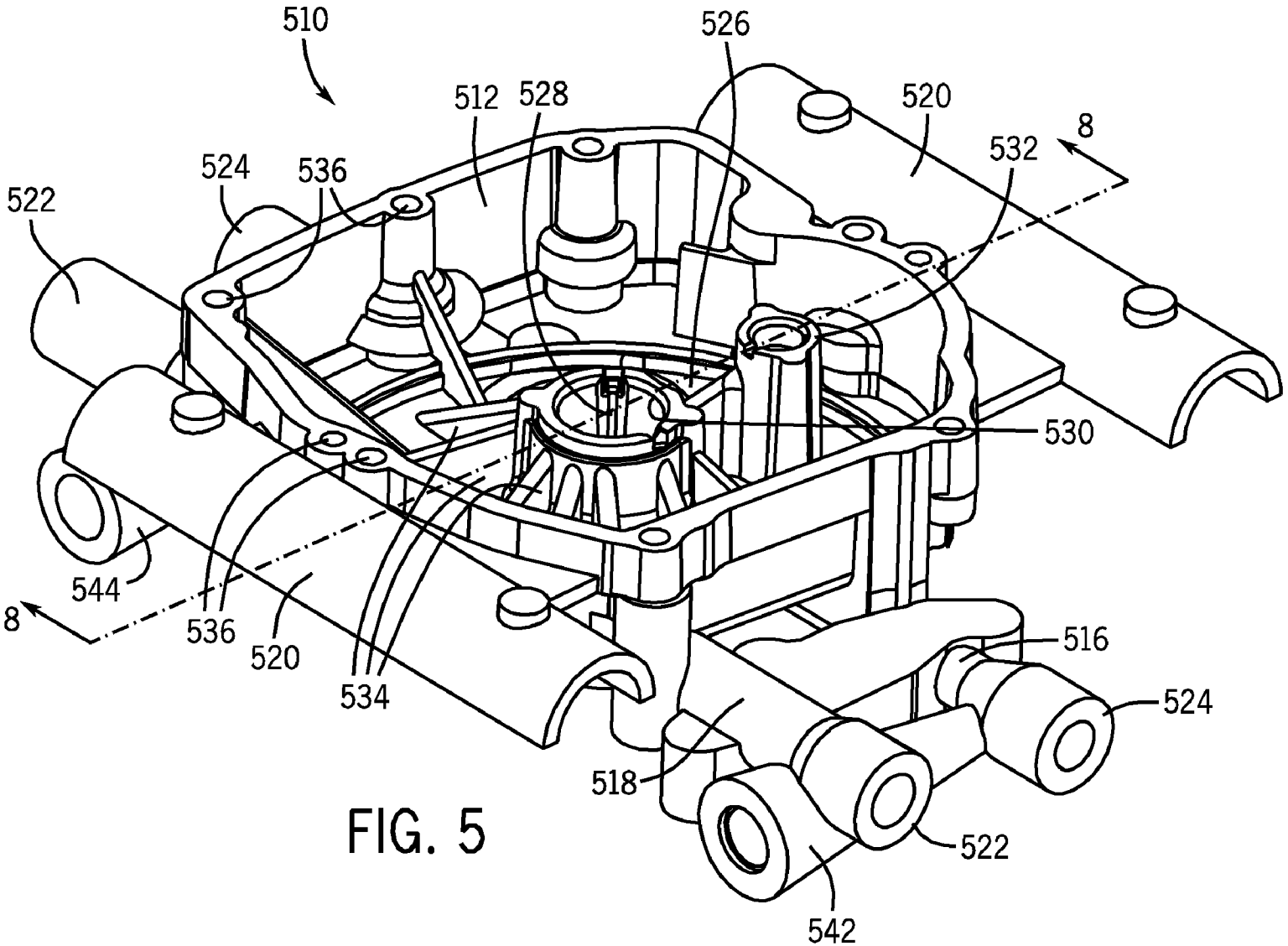
FIG. 5 is a perspective view of a portion of an engine according to an exemplary embodiment of the invention.
Figure 6:
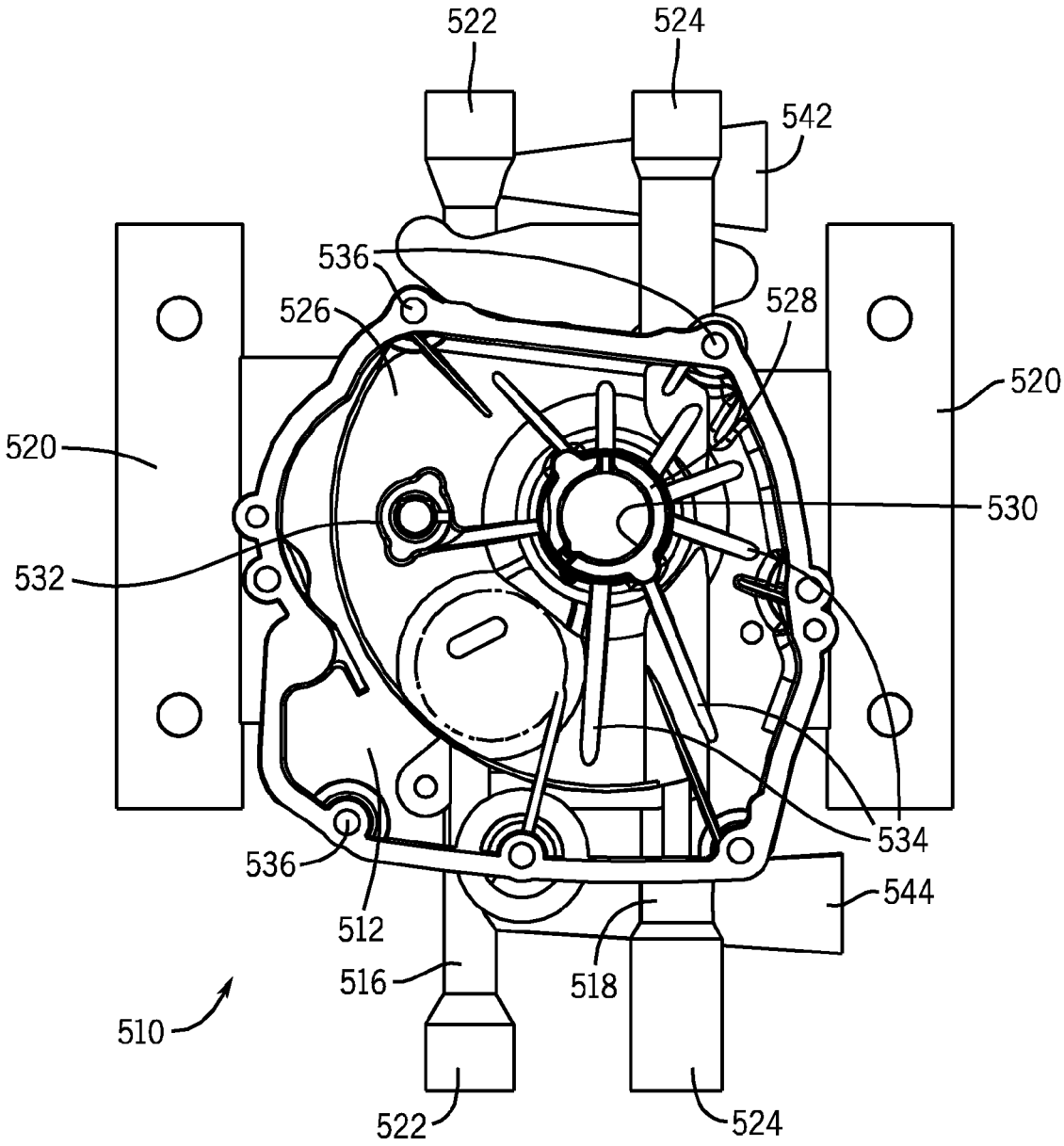
FIG. 6 is a top view of the portion of the engine of FIG. 5.

Referring to FIGS. 5-6, on a first side of the body 510 the base 512 of the engine block includes an oil sump 526 and a bearing 528 for a crankshaft surrounding an opening 530 for a power takeoff (e.g., crankshaft 226 and power takeoff 260 as shown in FIG. 2). In a vertically-shafted engine, the sump 526 may be the cover (e.g., cover 246 as shown in FIG. 2) of the engine block, while in a horizontally-shafted engine (see, e.g., engine 1012 as shown in FIG. 14), the sump may be formed in both a cover and the engine block. On the first side of the body 510, the base 512 also includes a bearing 532 for a camshaft, reinforcement structure 534, mounting holes 536 (e.g., thru-mounting holes, through-mounting holes, etc.) for fastening the base 512 to an upper portion of the crankcase, and other features. In some embodiments, the bearing 528 is a bushing with a seal or a gasket to prevent oil from leaking through the opening 530. In other embodiments, the bearing 528 is a rolling-element bearing (e.g., ball bearing) or another form of friction-reducing support that allows for free rotation of the crankshaft. According to an exemplary embodiment, the oil sump 526 is a recessed area of the base 512 where oil or other lubricant collects and then is distributed throughout the crankcase during engine operation. The mounting holes 536 facilitate bolting of the base 512 to the an upper portion of the engine block.

Figure 8:
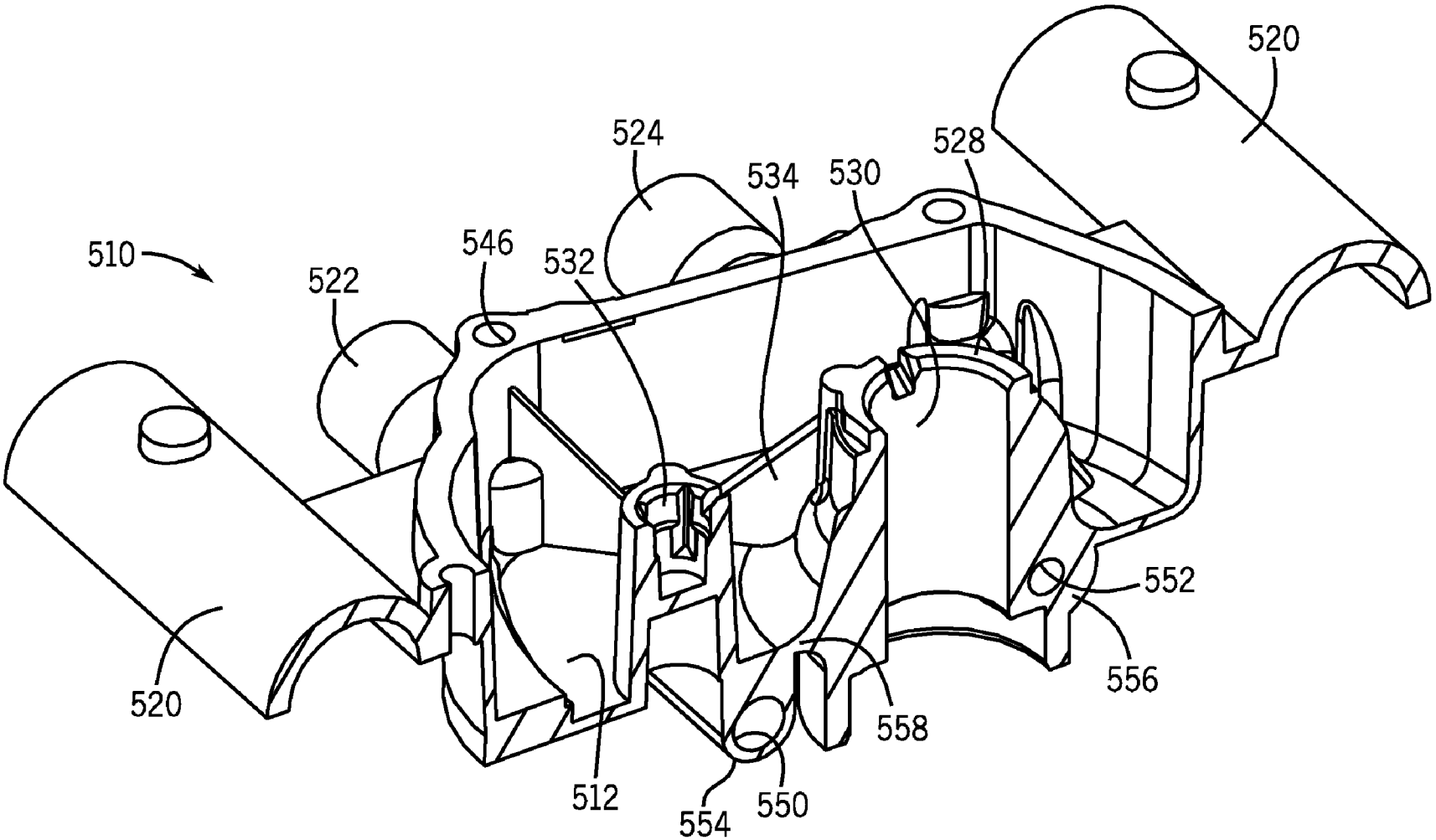
FIG. 8 is a sectional view of the portion of the engine of FIG. 5 taken along line 8-8.

Referring now to FIGS. 7-8, on a second side of the body 510, the top 514 of the pump housing includes the opening 530 for the power takeoff, which couples to a pumping mechanism (e.g., wobble plate 250 and pistons 256 as shown in FIG. 2, cams 316 and pistons 312 as shown in FIG. 3, or impeller 412 as shown in FIG. 4). The top 514 further includes apertures 538 for fastening a lower portion of the pump housing to the top 514, and apertures 540, 546 in the inlet and outlet pipes 516, 518 that direct the water to and from the pumping mechanism. As shown in FIG. 8, the inlet and outlet 522, 524 connect to fluid passages 550, 552 integrally formed in the body 510, with portions of the body 554, 556 forming the walls of the passages 550, 552.

Referring to FIG. 7, the inlet and outlet pipes 516, 518 are coupled to a starter valve 542 and an unloader valve 544. The starter valve 542 allows water entering the inlet pipe 516 to circulate without loading the engine (e.g., engine 212 as shown in FIG. 2), so that the engine may be started without simultaneously driving the pump. After the engine has started, changing water pressure switches a pressure-sensitive valve within the starter valve 542, which automatically allows the pump to substantially raise or increase pressure of the water, or switches the pump to a high pressure delivery mode. The unloader valve 544 allows for water passing through the pump to be circulated in a bypass circuit (i.e., loop) within the pump when the pressure washer sprayer (e.g., spray gun 142 as shown in FIG. 1) is off but the engine is running In other embodiments, the starter valve 542 may include a thermal relief valve, to release hot water generated by circulated water in a bypass circuit.

The attachment supports 520 include half-cylindrical sleeves sized to saddle (i.e., fit over a portion of) tubular rails on a support frame (e.g., support frame 116 as shown in FIG. 1). In other embodiments, there are more than two attachment supports. In some embodiments, the attachment supports have square, oval, or other shaped cross-sections. The attachment supports 520 may be bolted, welded, glued, or otherwise fastened to the rails. In still other embodiments, a base plate or other intermediate member is used to couple the engine or pump to a support frame without the use of attachment supports.

Referring to FIGS. 5-8, the inlet and outlet pipes 516, 518 extend through and from the body 510, and supply water to and from the pump (e.g., pump 114 as shown in FIG. 1).

According to an exemplary embodiment, the inlet pipe 516 includes at least one coupling 522, such as male or female quick-connect coupling or threaded coupling for a garden hose (e.g., ¾-inch garden hose, or other sizes). The outlet pipe 518 includes a coupling 524 for a high-pressure water hose (e.g., hose 146 as shown in FIG. 1). In some embodiments, the outlet pipe 518 has a greater wall thickness than the inlet pipe 516 (see, e.g., portions of the body 554, 556 forming the walls of the passages 550, 552 as shown in FIG. 8) because water passing through the inlet pipe 516 may be at a significantly lower pressure (e.g., 40-60 psi) than the water passing through the outlet pipe 518 (e.g., between 1000 to 3000 psi, or more).

According to an exemplary embodiment the inlet and outlet pipes 516, 518 are integrally formed with the base 512, and extend through the sump 526. In other embodiments, the pipes extend along one of the sides of the body 510. In still other embodiments, the lengths of the pipes extend through the open area of the sump, but are spaced apart from the body, where only a portion of the pipes passes through a wall of the body to enter the pump. In some embodiments, each of the pipes 516, 518 has two or more hose couplings 522, 524 (e.g., two openings with treaded or quick connect fittings) providing access to the pipes 516, 518 from different sides of the body 510 (e.g., opposite sides of the body 510), such as the pipe 516 with a first opening on a first side of the body 510 and a second opening on a second side of the body 510, opposite to the first side.

Figure 9:
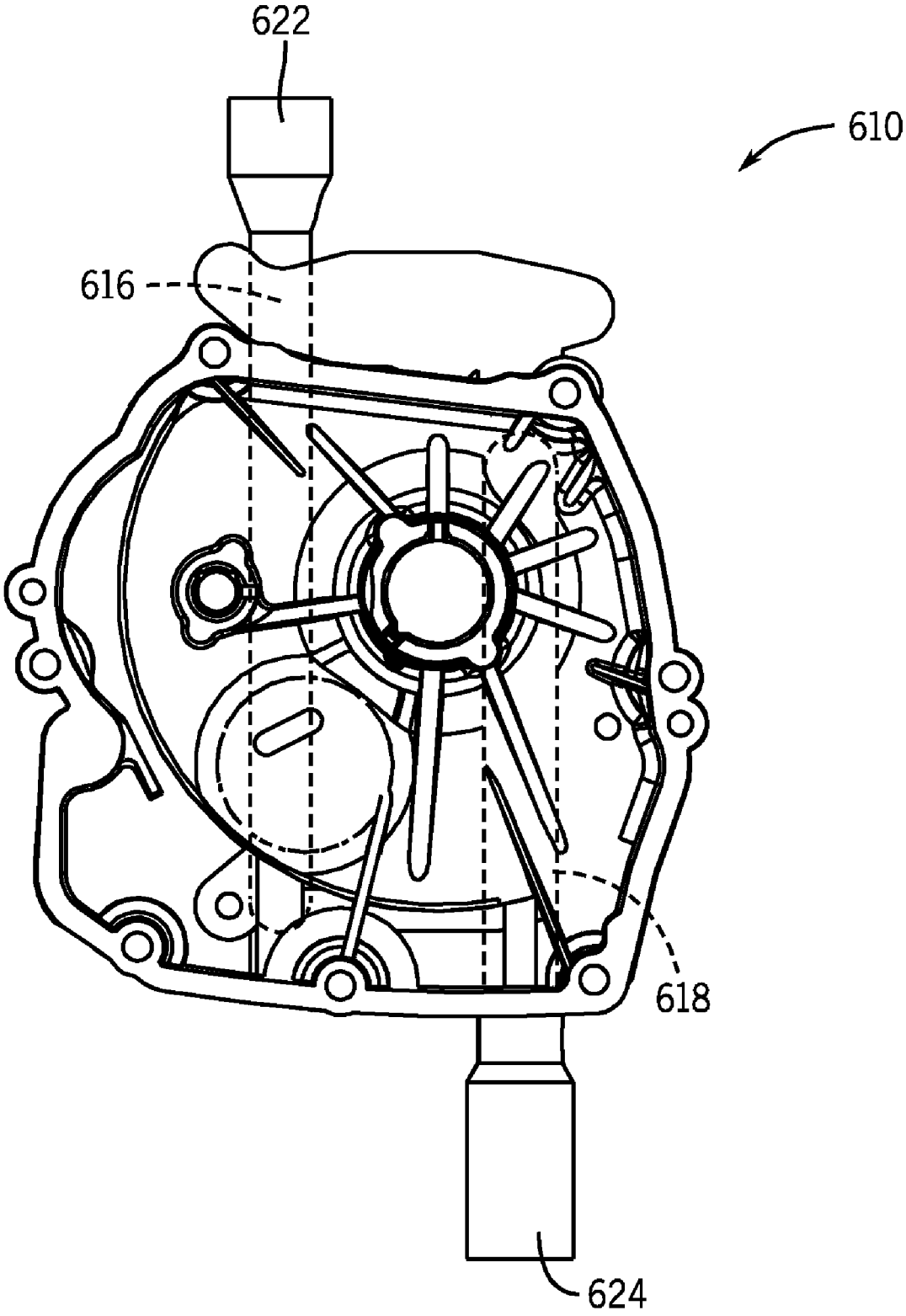
FIG. 9 is a top view of a portion of an engine according to another exemplary embodiment of the invention.

Referring to FIG. 9, a body 610, such as a cover for an engine block that is also a top of a pump housing, includes only a single hose coupling 622 for an inlet pipe 616 and only a single hose coupling 624 for an outlet pipe 618. According to an exemplary embodiment, the hose couplings 622, 624 are positioned on opposite sides of the body 610. In some embodiments hose couplings are oriented in perpendicular directions relative to each other, and in other embodiments the hose couplings extend from a body in the same direction and are accessible from the same side. In still other embodiments, only the inlet pipe or only the outlet pipe is integral with the body. The other pipe separately connects to the pump. Some embodiments include multiple inlet or outlet pipes that extend through the body.

Still referring to FIG. 9, the body 610 does not include integrally-formed attachment supports for fastening the body 610 to a support frame. Instead, the body 610 may be fastened to a support frame via an intermediate base plate. In some embodiments, a conventional mounting flange is used to mount the body 610 to a base plate (see, e.g., base plate 1016 as shown in FIG. 14, and base plate 1116 as shown in FIG. 15). For example, the mounting flange may be arranged with mounting holes in accordance with SAE International standards, such as SAE J609b, Surface Vehicle Recommended Practice, as revised in July 2003, which applies to mounting flanges and power take-off shafts for both vertical crankshaft engines (i.e., vertically-shafted) and horizontal crankshaft engine (i.e., horizontally-shafted).

Figure 10:
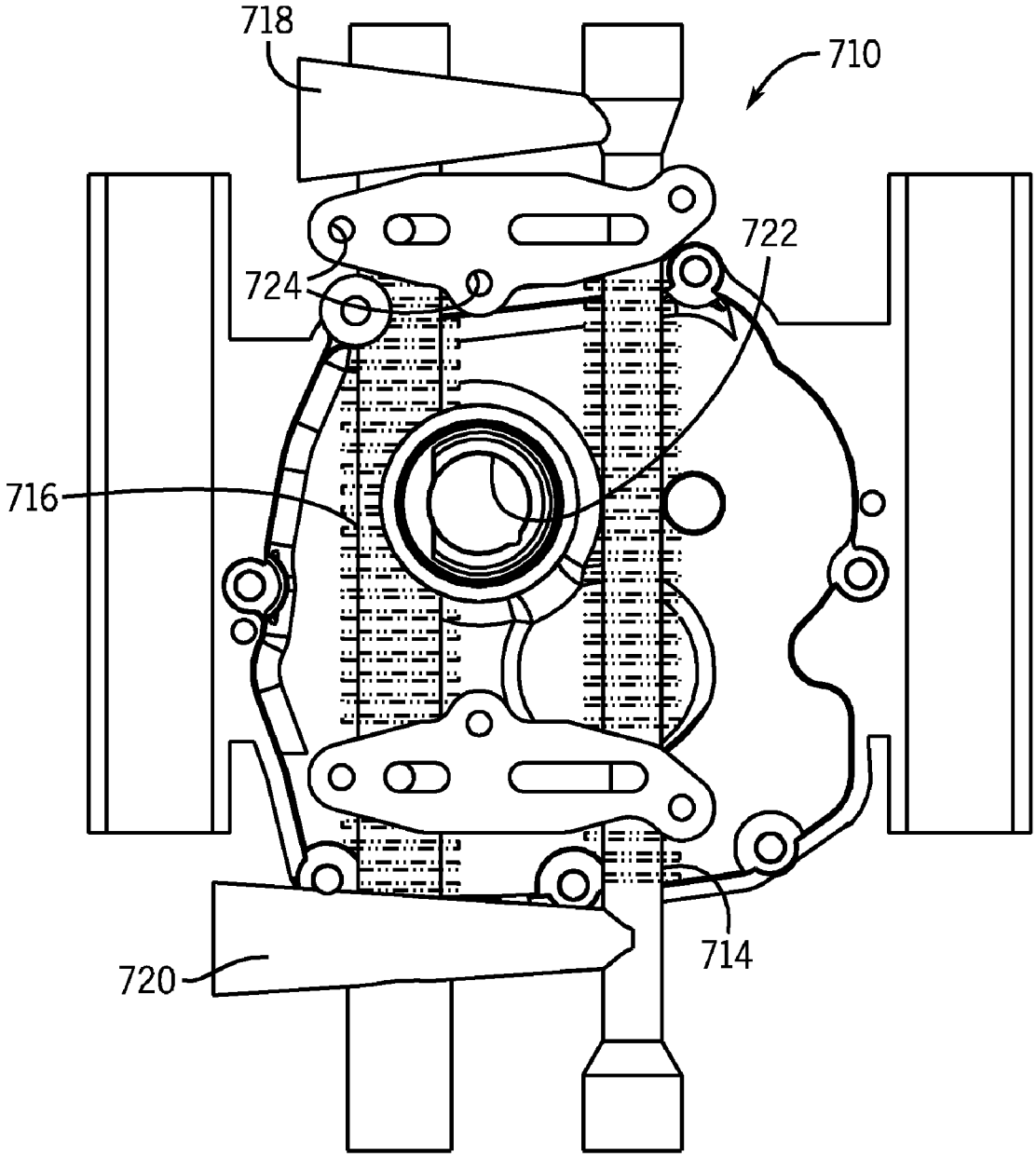
FIG. 10 is a bottom view of a portion of an engine according to yet another exemplary embodiment of the invention.

Referring now to FIG. 10, a body 710 includes a portion of a pump housing having an inlet pipe 714 and an outlet pipe 716 extending through the body 710. The body 710 further includes a starter valve 718 and an unloader valve 720, an opening 722 for a power takeoff of an engine or motor, and apertures 724 for coupling a lower portion of the pump housing to the body 710. The body 710 may also function as a base of a crankcase on an opposite side of the body 710. As the base of the crankcase, the body 710 includes a sump for engine oil (see, e.g., base 512 as shown in FIG. 6). According to an exemplary embodiment, the pipes 714, 716 are coupled to the body 710 such that water passing through the pipes 714, 716 cools oil in the sump.

Either or both of the inlet and outlet pipes 714, 716 include fins to increase the surface area of the pipes 714, 716, for greater heat transfer. The fins may extend into the interior of the body 710, may extend to the exterior of the body 710, or both. In other embodiments, wall thicknesses of the pipes 714, 716 are reduced to the extent feasible to allow for greater heat transfer. In some embodiments, the pipes 714, 716 are formed from a material having a high thermal conductivity, such as a separate copper pipe (or copper pipe segments) extending through an aluminum body and sump. In other embodiments the pipes 714, 716 have cross-sectional geometries that facilitate heat transfer from the oil to water. For example, in at least one embodiment the pipes have relatively flat cross-sections, providing a wide surface area that is exposed to the bottom of the sump. In these and other embodiments, the pipes may be integrally formed with the body 710, or may be separately formed and coupled to the body 710.

Figure 11:
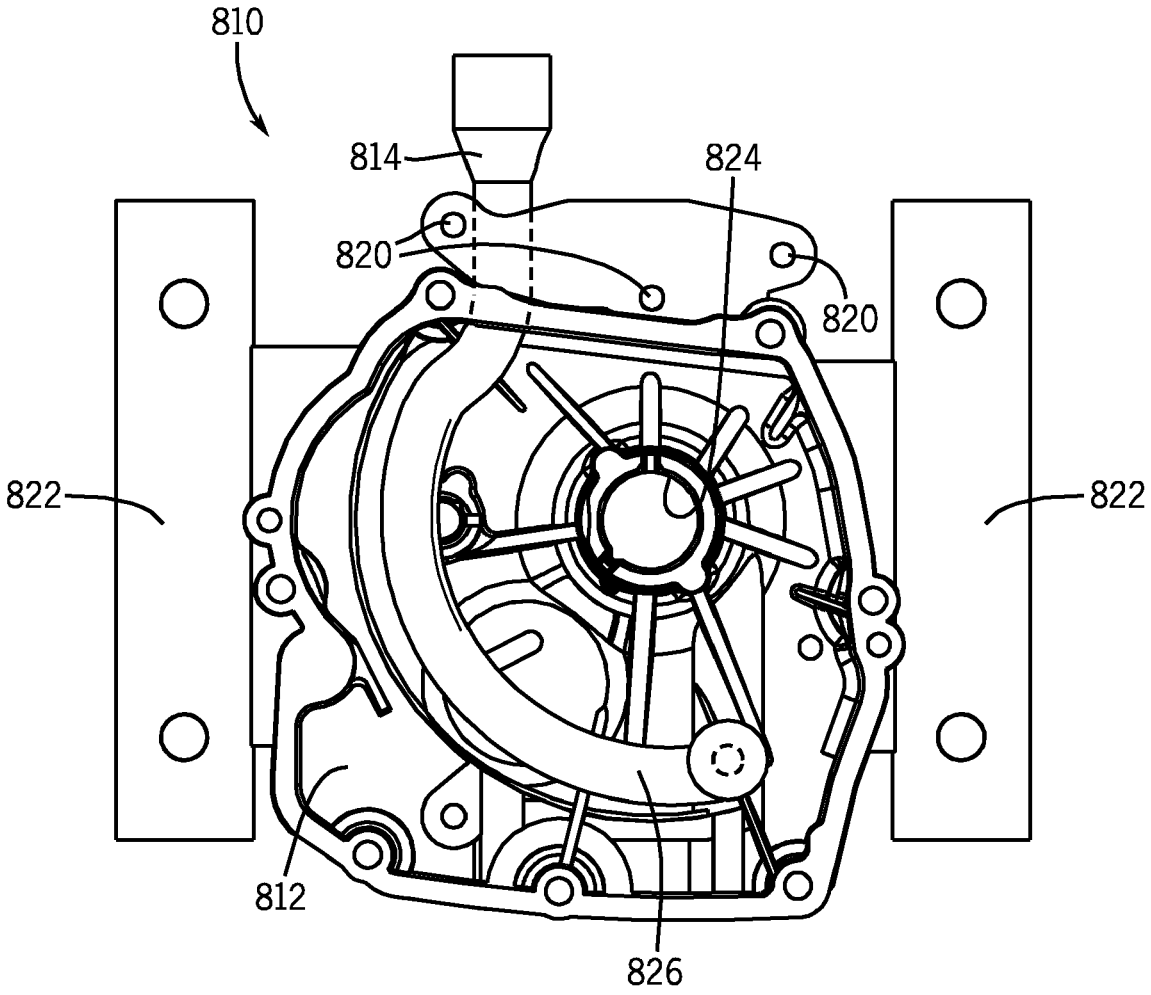
FIG. 11 is a top view of a portion of an engine according to still another exemplary embodiment of the invention.
Figure 12:
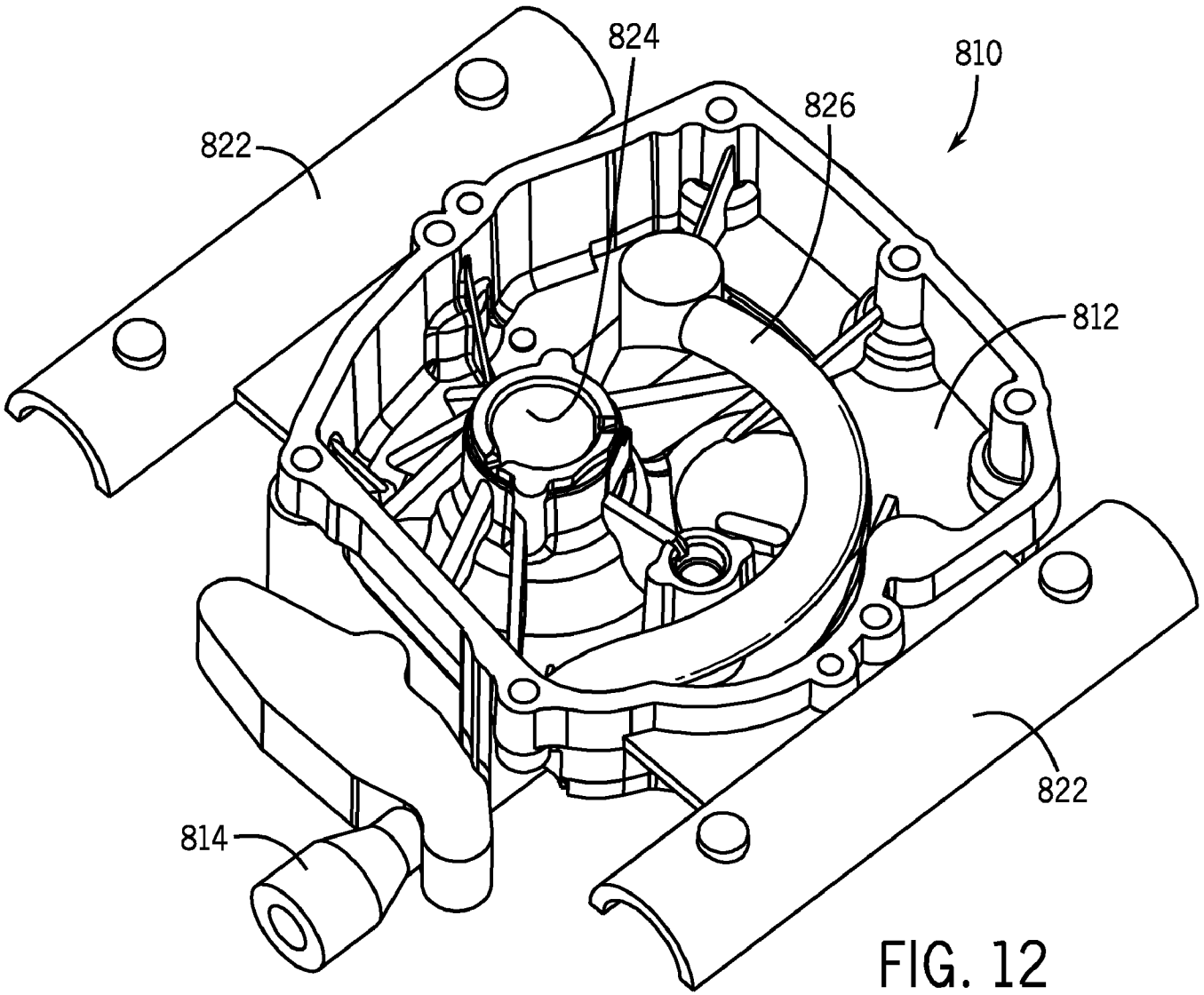
FIG. 12 is a perspective view of the portion of the engine of FIG. 11.

Referring now to FIGS. 11-12, a body 810 may function as a top 812 of a pump housing having an inlet 814 and inlet conduit 826 extending through body 810. The body 810 further includes an opening 824 for a power takeoff of an engine or motor, and apertures 820 for coupling a lower portion of a pump housing to the body 810. The body 810 may also function a base of a crankcase with a sump for engine oil positioned on a side of the body 810 that is opposite to the top 812. According to an exemplary embodiment, the inlet conduit 826 is coupled to the body 810 such that water passing through the inlet conduit 826 cools oil in the sump. The body 810 may be fastened to a support frame with support mountings 822.

The inlet conduit 826 has curvature along the length of the inlet conduit 826, and stretches around the perimeter of the sump. Increased length of the inlet conduit 826 may enhance heat transfer from the oil to the water, relative to shorter inlet pipes, such as the pipe 516 as shown in FIGS. 5-8. In other embodiments, the inlet and outlet conduits have different lengths and curvatures, such as an S-shaped pipe or a C-shaped pipe, etc. that may increase heat transfer from the crankcase oil to water flowing through the pipes.

Figure 13:
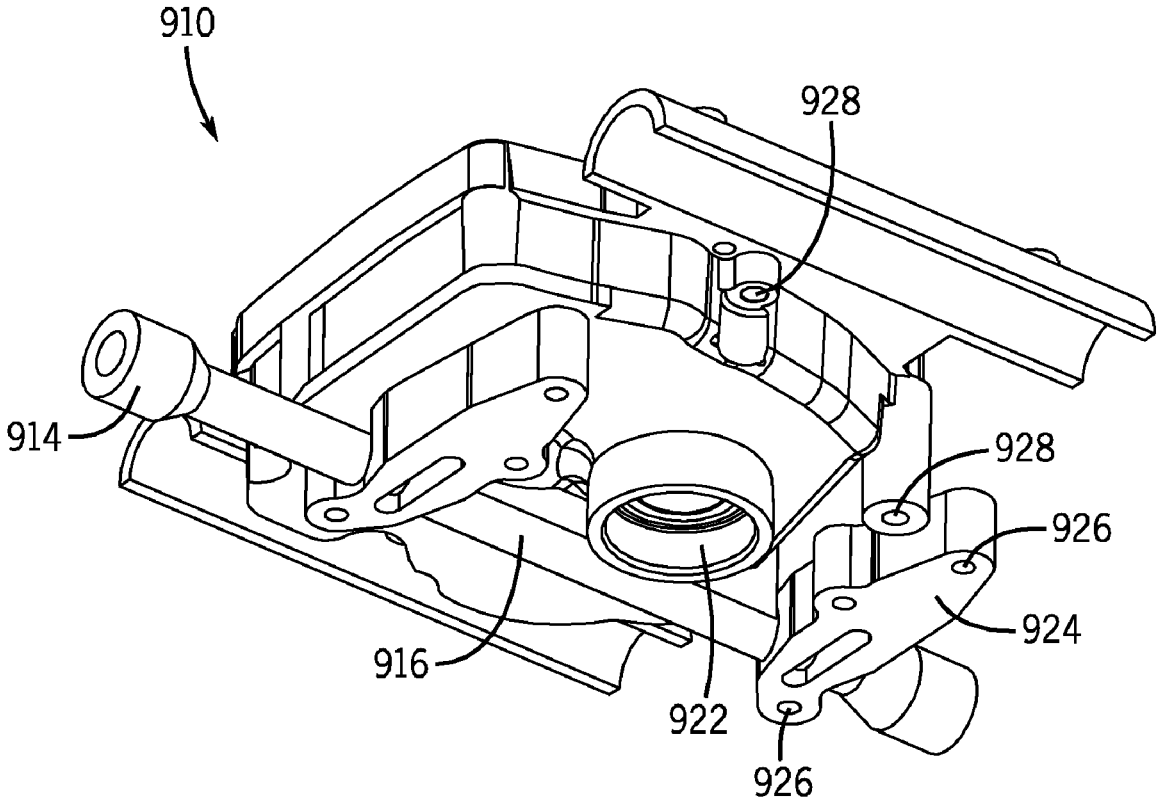
FIG. 13 is a perspective view of a portion of an engine according to another exemplary embodiment of the invention.
Figure 20:
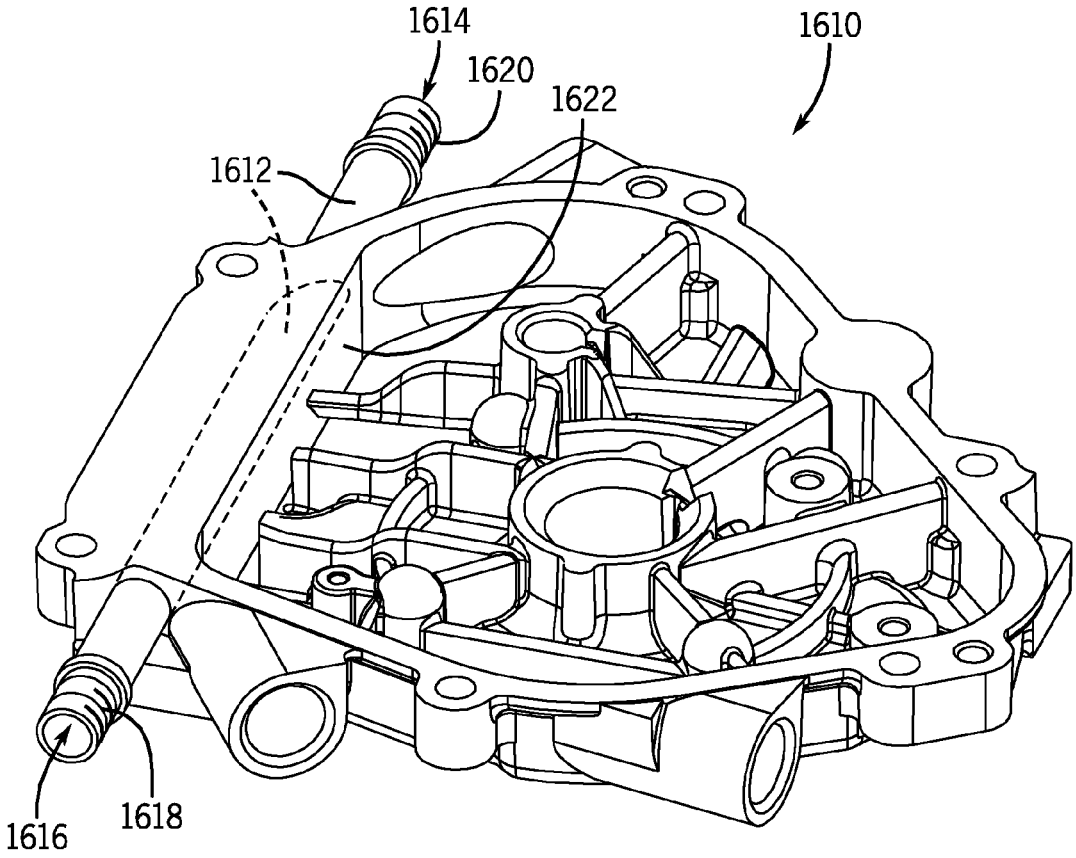
FIG. 20 is a perspective view of an engine cover according to another exemplary embodiment of the invention.

Referring now to FIG. 13, a body 910 includes an inlet 914 and an inlet conduit 916 for a high pressure water pump. In some embodiments, the body 910 includes mounting flanges 924 and mounting holes 926 for bolting the body 910 to the water pump. The body 910 also includes mounting holes 928 for bolting the body 910 to an engine block, crankcase, etc. According to an exemplary embodiment, the inlet 914 and inlet conduit 916 are integrally formed with the body 910, and an outlet for the water pump is separately formed and attaches separately to the water pump. The body further includes an opening 922, through which a power takeoff of a combustion engine may engage the pump. In other embodiments, the body 910 does not include mounting flanges 924 and mounting holes 926, but does have an inlet conduit (e.g., a hose, a pipe, a tube, etc.) passing through the body 910, which may then be coupled to direct water into a pump that is separate from the body 910. In other embodiments, a body includes a conduit but does not include mounting flanges (see, e.g., cover 1110 as shown in FIG. 20).

Referring to FIG. 14, a pressure washer system 1010 includes a support frame 1014, an internal combustion engine 1012, and a water pump 1018. The water pump 1018 is integrated with the engine 1012, which is mounted to a base plate 1016 of the support frame 1014. In some embodiments, the engine 1012 and the pump 1018 share an integral body that forms a portion of the engine block (e.g., a side wall) and a portion of the pump housing (see, e.g., body 510, 610, 710, 810, and 910 as shown in FIGS. 5-13). The engine 1012 is a horizontally-shafted engine that includes an engine block with a sump formed in a base of the engine block.

Referring to FIG. 15, a pressure washer system 1110 includes a support frame 1114, an internal combustion engine 1112, and a water pump 1118. The engine 1112 is a vertically-shafted engine that is mounted to a top side of a base plate 1116, and the pump 1118 is mounted to an underside of the base plate 1116. In some embodiments, the engine 1112 and the pump 1118 share an integral body that forms a portion of the engine block (e.g., a base, a sump, etc.) and a portion of the pump housing (see, e.g., body 510, 610, 710, 810, and 910 as shown in FIGS. 5-13). Such embodiments may be mounted on top of a base plate, from beneath the base plate, or directly to a frame, such as with threaded fasteners extending through mounting holes in each of the integral body and the base plate. In other embodiments, such as the embodiment shown in FIG. 1, the assembly may mount without a base plate, such as mounted directly to the support frame (e.g., bolted, welded, pinned, glued, or otherwise fastened to the support frame). In still other embodiments, a first of either the engine or the pump may be fastened to a base plate and the second of the engine or the pump may be fastened to the first, such as the engine mounted to the base plate and the pump mounted to the engine.

Figure 16:
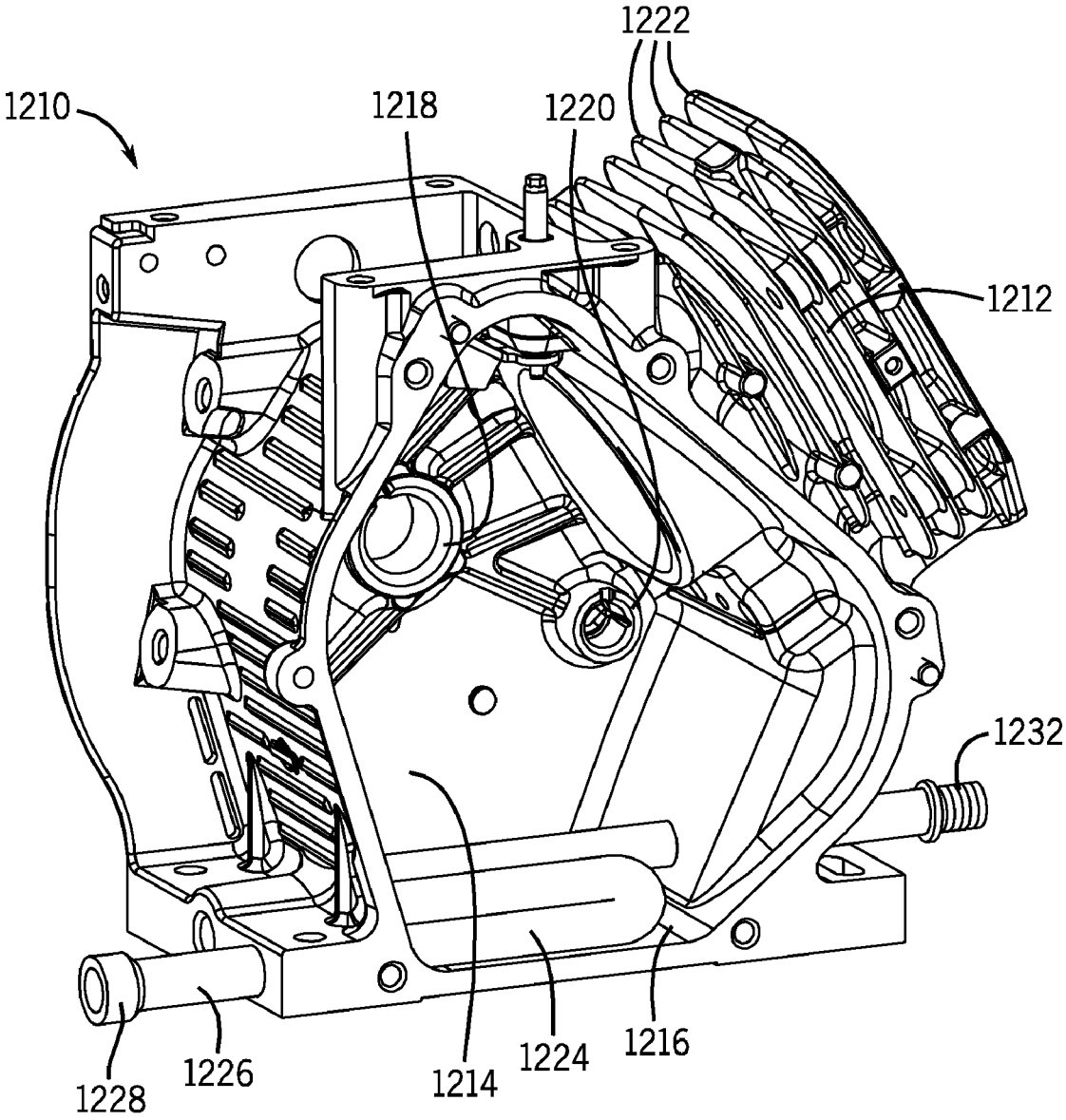
FIG. 16 is a perspective view of a portion of an engine according to another exemplary embodiment of the invention.

Referring now to FIG. 16, an engine block 1210 of a horizontally-shafted engine (see, e.g., engine 1012 as shown in FIG. 14) includes a cylinder portion 1212, a crankcase portion 1214, a sump portion 1216, and bushings 1218, 1220 for a crankshaft (see, e.g., crankshaft 226 as shown in FIG. 2) and a camshaft (not shown). The sump 1216 may be formed within the engine block 1210, such as when the engine block 1210 is fastened to a cover (see, e.g., cover 1610 as shown in FIG. 20). The sump 1216 may include a recessed portion, such as a bowl or a basin, formed in a base of the engine block 1210, or may simply be the interior base of the engine block without a separate recessed portion, where oil or other lubricant would pool during operation of the engine. During operation of the engine, internal combustion processes drive a piston (see, e.g., piston 242 as shown in FIG. 2), which translates within the cylinder portion 1212. According to an exemplary embodiment, the cylinder portion 1212 includes exterior fins 1222 for air cooling. The piston drives the crankshaft, which rotates within the bushing 1218. A power takeoff may extend from the crankshaft to power tools, such as a pressure washer pump, an air compressor, etc. The crankshaft may include gearing, a pulley, or other components for coupling the crankshaft to the camshaft, which rotates in the camshaft bushing 1220. In other embodiment, the horizontal engine may be a twin cylinder engine, a vee engine, or another engine type.

Motor oil, or other lubricant, may be contained in the engine block 1210 to lubricate various moving components (e.g., crankshaft, camshaft, piston, etc.). The motor oil in the engine block 1210 may pool in a base of the engine block, such as in the sump 1216. The sump 1216 may be a recessed portion (e.g., bowl, well, recess, tub, basin, pool, etc.) of the engine block 1210, or may simply be a base portion of the engine block 1210 designed to hold or contain the lubricant. The motor oil may then be distributed about the engine by slingers, dippers, moving components, pumps, or other lubrication distribution systems. Friction from the moving components and burning of fuel via the combustion processes may heat the motor oil. Heat transferred to the oil cools the moving components, which may improve engine efficiency and life.

According to an exemplary embodiment, a fluid conduit 1224 (e.g., passage, pipe, channel, vessel, etc.) may be coupled to, provided within, or provided outside of the engine block 1210. The fluid conduit 1224 allows for a flow of water from a water source to pass into and out of the engine, which may cool components of the engine or the motor oil. The water source may be a faucet or garden hose spigot connected to a home water supply, a storage tank, such as a tank carried by a vehicle (e.g., tank truck), or another source. The water source may be connected to an inlet 1226 of the fluid conduit 1224 via a garden hose, which may be attached to a hose connector on an end of the fluid conduit 1224. In some embodiments, the end of the fluid conduit 1224 includes a threaded female hose connector 1228 for coupling a garden hose to the fluid conduit 1224. Another end of the fluid conduit 1224 includes a threaded male hose connector 1232, also for coupling a garden hose to the fluid conduit 1224. In other embodiments, the hose connectors are male and female quick connect couplings, or other types of hose connectors. In still other embodiments, one of the ends of the fluid conduit 1224 connects directly to a water pump, or other tool.

As shown in FIG. 16, the fluid conduit 1224 passes through a wall of the engine block 1210 and extends through a chamber within the engine block 1210 (e.g., crankcase 1214). Seals, gaskets, compression, or other sealants may block oil from passing through the wall of the engine block 1210, around the exterior of the fluid conduit 1224. According to an exemplary embodiment, the fluid conduit 1224 bends (i.e., curves, winds, arcs, etc.) within the chamber of the engine block 1210 such that water flowing through the fluid conduit 1224 curves within the engine block 1210. In other embodiments, the fluid conduit is straight. Still referring to FIG. 16, the fluid conduit 1224 exits the engine block 1210 by passing through a wall of the engine block 1210, and projecting away from the engine block 1210. In some embodiments, the fluid conduit 1224 includes a series of pipes fastened together, either in series or in parallel with each other. In other embodiments, the fluid conduit 1224 is formed from a single copper or aluminum pipe. In still other embodiments, the fluid conduit 1224 is integrally formed within one or more walls of the engine block 1210, similar to the embodiments shown in FIGS. 8, 19, and 20. In such an embodiment, the conduit 1224 may be cast or otherwise formed with the engine block or cover, and formed with continuous material between the interior of the engine block or cover, and the water passage of the conduit 1224. The continuous material may be a heat conductive metal that is sized, contoured, and arranged to facilitate heat transfer between oil of the engine block and water passing through the conduit 1224.

According to an exemplary embodiment, the fluid conduit 1224 may also be connected to a pressure washer pump, and may direct water to a pumping mechanism of the pump (see, e.g., pump 214 as shown in FIG. 2, pump 310 as shown in FIG. 3, and pump 410 as shown in FIG. 4). While a pressure washer system may be a preferred embodiment, in other embodiments, the fluid conduit 1224 directs water to a tool, such as a sprinkler or sprayer that is not associated with a pressure washer. In some embodiment, fluids other than water pass through the fluid conduit to cool the engine. In at least one embodiment, the engine powers an air compressor and air passes through the fluid conduit 1224, into the air compressor. Heat is transferred from the engine, to the air passing through the fluid conduit 1224.

Figure 17:
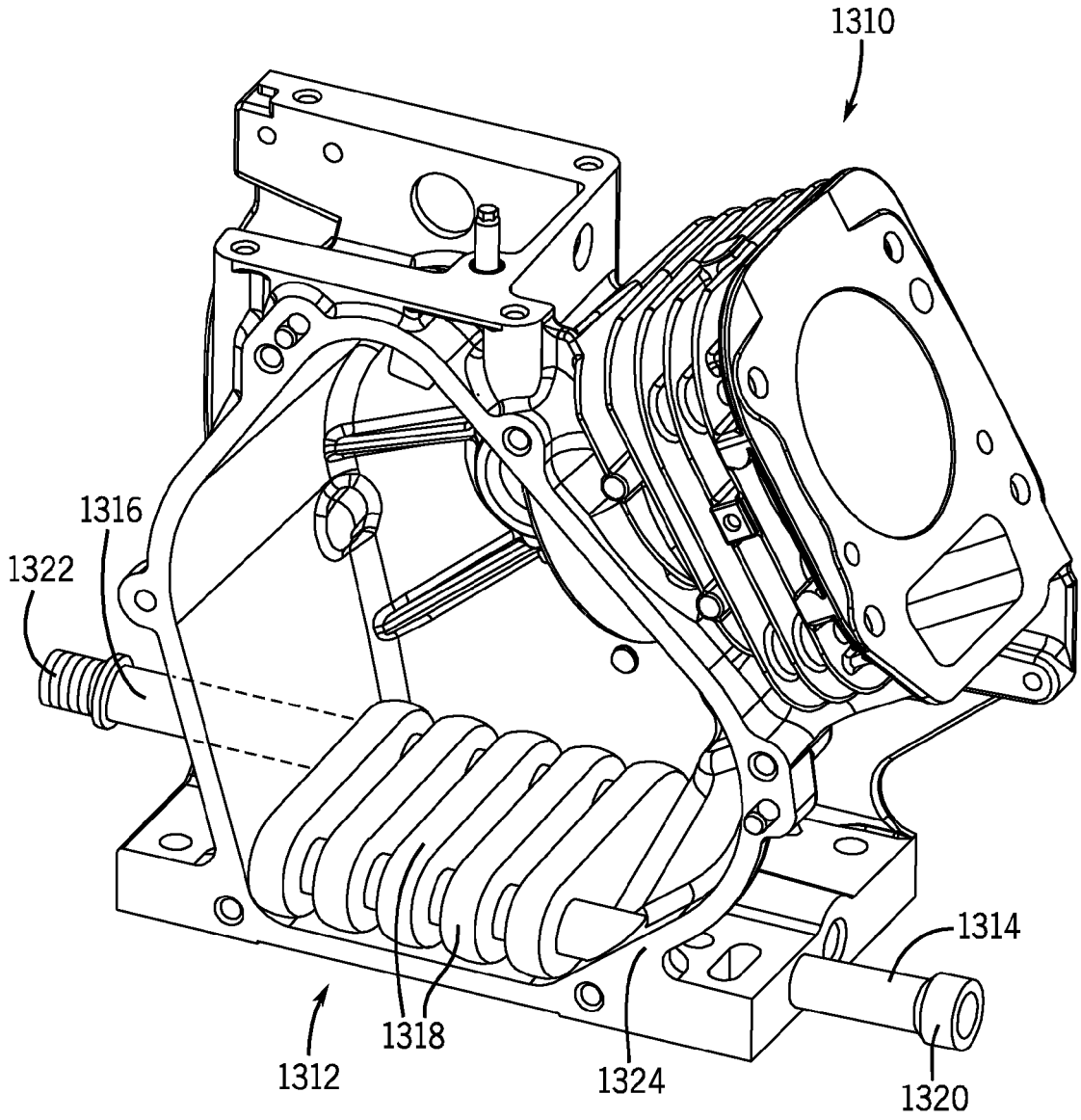
FIG. 17 is a perspective view of a portion of an engine according to yet another exemplary embodiment of the invention.

Referring now to FIG. 17, an engine block 1310 for a horizontally-shafted engine includes a fluid conduit in the form of a heat exchanger 1312 (e.g., oil cooler, radiator, etc.). The heat exchanger 1312 includes an inlet 1314 and an outlet 1316, each extending from the engine block 1310. In some embodiments, the inlet 1314 and the outlet 1316 extend from the same side of the engine block 1310. The inlet 1314 and the outlet 1316 may include manifolds that are connected by a series of channels 1318 or narrower conduits. In some embodiments, an end of heat exchanger 1312 includes a female hose connector 1320 for coupling a garden hose, a pipe, or other conduit to the heat exchanger 1312. Another end of the heat exchanger 1312 includes a male hose connector 1322, for coupling a garden hose, a pipe, or other conduit to the heat exchanger 1312. In other embodiments, the hose connectors are male and female quick connect couplings, or other types of hose connectors. In still other embodiments, one of the ends of the heat exchanger 1312 connects directly to a water pump, or other tool.

Water enters the inlet 1314, passing through a wall 1324 of the engine block 1310. The water additionally passes through a series of narrow, parallel channels 1318 (i.e., parallel, in that a flow may be divided into a number of simultaneously running smaller flows through different channels 1318). In some embodiments, the channels 1318 may be formed from copper, aluminum, brass, plastic (although metal is preferred in some embodiments), or other materials suitable for heat flow from oil to water (e.g., thermal conductivity greater than 10 W/(m·K), preferably greater than 100 W/(m·K)). In such embodiments, the channels 1318 are designed to transfer heat from the engine or engine oil to the water passing through the heat exchanger 1312. Water may be pushed through the channels 1318 by back pressure, may be pulled through the channels 1318 by a pumping mechanism, or otherwise motivated.

According to an exemplary embodiment, the inlet 1314 of the heat exchanger 1312 may be coupled to a water source via a garden hose, and the outlet 1316 of the heat exchanger 1312 may be coupled to a pressure washer pump (see, e.g., pump 214 as shown in FIG. 2, pump 310 as shown in FIG. 3, and pump 410 as shown in FIG. 4), or other powered tool. Seals, gaskets, welds, treading, or a tight fit may be used to seal the fluid conduit as it passes through walls of the engine block 1310. In other embodiments, the inlet 1314, the outlet 1316, or the channels 1318 are integrally formed with the engine block 1310. In still other embodiments, the heat exchanger is positioned on an outside surface (e.g., wall) of the engine block 1310, and does not pass through walls of the engine block 1310. For example, in at least one embodiment, narrower channels of a heat exchanger wrap around a cylinder portion of the engine block. In some embodiments, an outlet pipe or conduit of the water pump, with pressurized water, may pass through the engine block to cool the engine.

Figure 18:
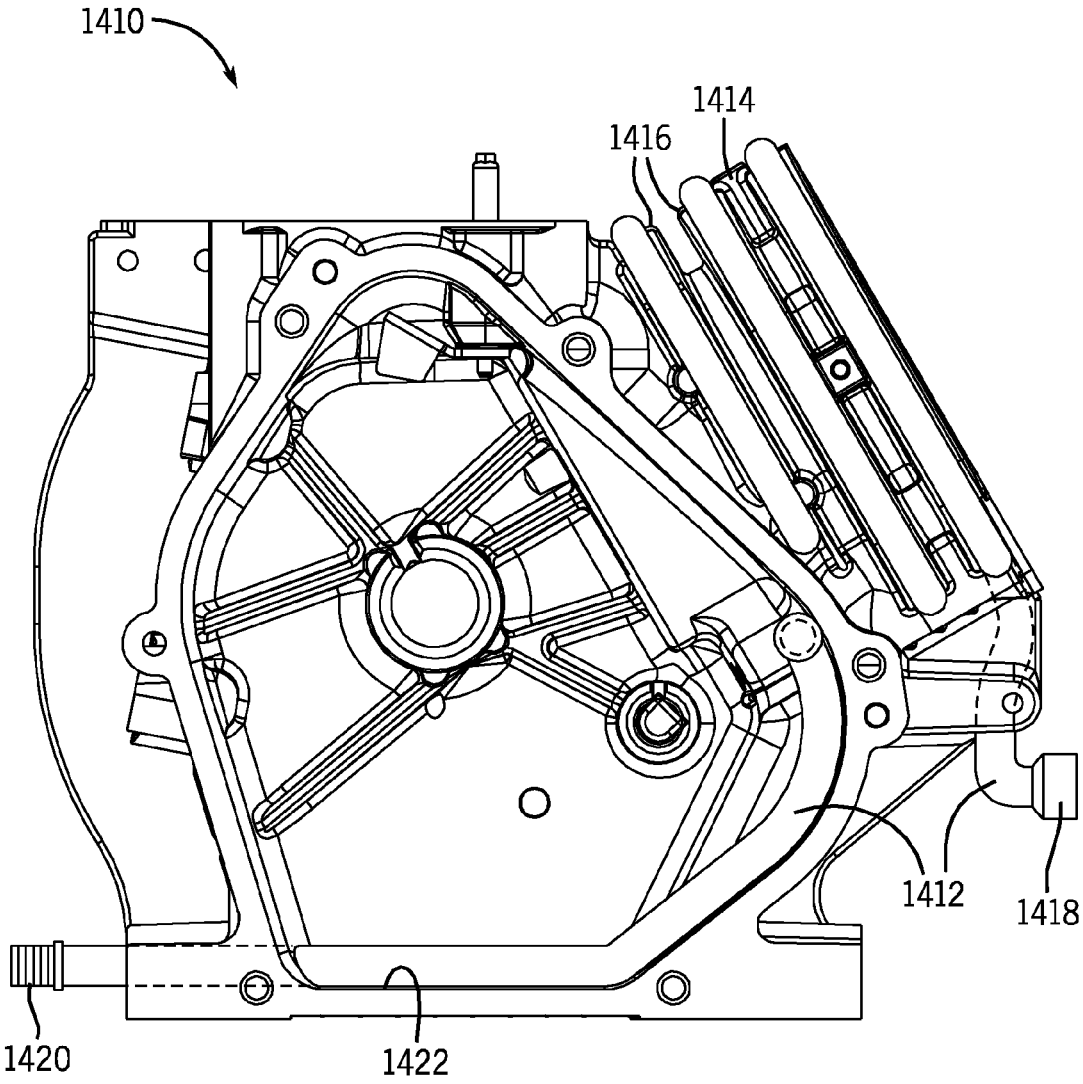
FIG. 18 is a side view of a portion of an engine according to still another exemplary embodiment of the invention.

Referring to FIG. 18, an engine block 1410 for a horizontally-shafted engine includes a fluid conduit in the form of a water conduit 1412 that is coupled to a cylinder block 1414 of the engine block 1410. The water conduit 1412 may be integrally formed with the cylinder block 1414, similar to the embodiments shown in FIGS. 8, 19, and 20, or may be a separate component that has been fastened to the cylinder block 1414. Directly coupling the conduit 1412 to the cylinder block 1414 may improve performance of the cylinder block 1414 by increasing heat transfer from the cylinder block 1414 during operation of the engine block 1410. In at least one embodiment, the water conduit 1412 is a brass, copper, aluminum or other suitable material tube that has been wrapped around the cylinder block 1414. According to an exemplary embodiment, the water conduit 1412 extends around (e.g., loops, wraps, etc.) an exterior surface of the cylinder block 1414, forming at least one loop such that the conduit 1412 extends around the full periphery of the cylinder block 1414 at least once. In another exemplary embodiment, the water conduit 1412 is positioned within or between air cooling fins 1416 of the cylinder block 1414. In some embodiments, an end of water conduit 1412 includes a female hose connector 1418 for coupling a garden hose, a pipe, or other conduit to the water conduit 1412. Another end of the water conduit 1412 includes a male hose connector 1420, for coupling a garden hose, a pipe, or other conduit to the water conduit 1412. In other embodiments, the hose connectors are male and female quick connect couplings, or other types of hose connectors. In some embodiments, the water conduit may include connectors for other types of hoses, such as high pressure hoses, fire hose, plumbing pipes, and the like. In some embodiments, the water conduit 1412 is coupled to a pressure washer pump via an intermediate hose. In still other embodiments, one of the ends of the water conduit 1412 connects directly to a water pump, or other tool.

According to an exemplary embodiment, the water conduit 1412 extends from the cylinder block 1414 and passes through a wall of the engine block 1410 and into an interior chamber of the engine block 1410 (e.g., crankcase). A portion of the water conduit 1412 extends through a sump 1422 in a base of the engine block, such that oil in the sump 1422 may be cooled by water passing through the water conduit 1412. In other embodiments, the water conduit 1412 passes through the engine block 1410, but does not pass through sump 1422 or base of the engine block 1410. In such embodiment, the water conduit may still function to cool engine components, including oil that has splashed or otherwise been distributed onto or proximate to the water conduit 1412. In some embodiments, the water conduit 1412 coils around the cylinder block 1414, and does not pass through the walls of the engine block 1410.

Figure 19:
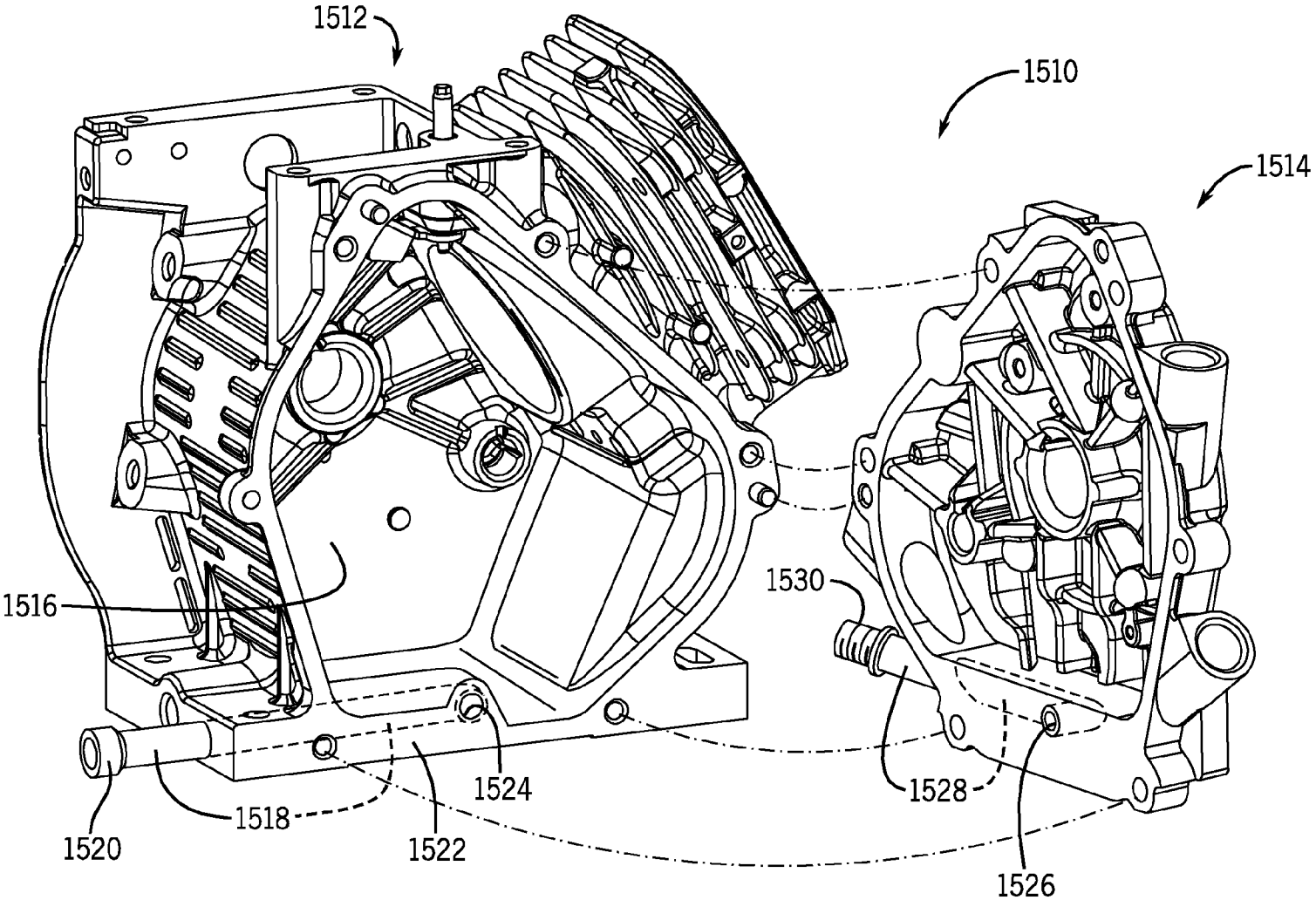
FIG. 19 is a perspective view of a an engine block and cover according to another exemplary embodiment of the invention.

Referring now to FIG. 19, a horizontal engine 1510 includes a block 1512 and a cover 1514 designed to be fastened to the block 1512, and to seal an interior chamber 1516 (e.g., crankcase) of the block 1512. Oil in the chamber 1516 may be used to cool and lubricate working components of the engine 1510. A conduit 1518 is integrally formed with the block 1512, and includes an inlet 1520. The conduit 1518 extends within a wall 1522 of the engine block 1512, such as a bottom of the block 1512. The conduit 1518 further includes an opening 1524. As shown in FIG. 19, the opening 1524 directs water from the block 1512 into an opening 1526 of a conduit 1528 that is integrally formed with the cover 1514. During operation, water passes through the cover 1514, and then out of the conduit 1528 via an outlet 1530. According to an exemplary embodiment, water for a separate water pump (and the like) enters the engine block via the inlet 1520, places through (e.g., between, within, past, into, etc.) the conduit 1518, which itself passes through the wall 1522 of the engine block 1512 of the engine 1510. The conduit 1518 runs parallel or along the wall 1522 of the engine block, in the sump thereof, allow heat to transfer from the interior of the engine block 1512 to the water passing through the conduit 1518. The water then exits the block 1512 via the opening 1524, which is connected to the opening 1526 of the cover 1514. As such, the water enters the conduit 1528 within the cover 1514 and passes therethrough, exiting the engine 1510 via the outlet 1530. In other embodiments, water takes a reverse path through the engine 1510, entering the outlet 1530 and exiting the inlet 1520. In some embodiments, the water may then be directed to a water pump, such as a high-pressure water pump of a pressure washer system.

Referring to FIG. 20, according to another exemplary embodiment, a conduit 1612 may be integrally formed with a cover 1610 for an engine block of a horizontal engine. The conduit 1612 includes an inlet 1614 and an outlet 1616, each of which having connectors 1618, 1620 designed to support a hose fastened thereto. In some embodiments, the conduit 1612 extends within a portion 1622 of the cover 1610 that is a adjacent to, or forms a wall of a sump of the engine. During operation of the engine, oil in the sump is cooled by water passing through the conduit 1612. The water may then be directed to a water pump for a pressure washer or other device.

The construction and arrangements of the pressure washer pump and engine system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A pressure washer system, comprising:

an engine block for a horizontally-shafted internal combustion engine, the engine block having a chamber therein, wherein the chamber is configured to contain oil for cooling and lubricating the engine;

a water conduit having a garden hose connector on an end thereof, the water conduit coupled to the engine block, whereby heat transfers from the engine block to a flow of water passing through the water conduit during operation of the pressure washer system;

a water pump coupled to the water conduit, wherein the flow of water is driven by the water pump; and a spray gun coupled to the water pump, wherein the flow of water exits the pressure washer system via the spray gun.

2. The pressure washer system of claim 1, wherein the water conduit extends through or is provided in at least a portion of the engine block.

3. The pressure washer system of claim 2, wherein the water conduit extends proximate a sump of the chamber, whereby heat transfers from the oil to the water during operation of the pressure washer system.

4. The pressure washer system of claim 3, wherein the water conduit is integrally formed with the engine block.

5. The pressure washer system of claim 4, wherein the garden hose connector comprises at least one of a threaded garden hose coupling or a quick connect garden hose coupling.

6. The pressure washer system of claim 1, wherein the water conduit is directly coupled to a portion of a cylinder portion of the engine block.

7. The pressure washer system of claim 6, wherein the water conduit extends around at least a portion of an exterior of the cylinder portion.

8. The pressure washer system of claim 7, wherein the water conduit is integrally formed with the cylinder portion.

9. A pressure washer system, comprising:

an internal combustion engine, comprising:

an engine block having a chamber therein, wherein the chamber is configured to contain a lubricant, and a crankshaft at least partially within the chamber;

a water pump, comprising a pumping mechanism powered by the crankshaft;

a water conduit extending through or being provided in at least a portion of the chamber of the internal combustion engine such that material continuously extends between the interior of the chamber and a flow of water passing through the water conduit during operation of the pressure washer system; and a spray gun coupled to the water pump;

wherein the water conduit directs the flow of water to the pumping mechanism, whereby heat transfers from the lubricant to the flow of water during operation of the pressure washer system; and wherein the flow of water exits the pressure washer system via the spray gun.

10. The pressure washer system of claim 9, wherein the water conduit is integrally formed with the engine block.

11. The pressure washer system of claim 10, wherein the engine block further comprises a garden hose connector extending therefrom, the garden hose connector on an end of the water conduit.

12. The pressure washer system of claim 11, wherein the water conduit curves within the portion of the chamber of the internal combustion engine.

13. The pressure washer system of claim 12, wherein the water conduit comprises parallel flow paths through the portion of the chamber of the internal combustion engine.

14. The pressure washer system of claim 13, wherein the internal combustion engine is at least one of a horizontally-shafted and a vertically-shafted engine.

15. The pressure washer system of claim 9, wherein the water conduit is fastened to a wall of the engine block.

16. The pressure washer system of claim 9, wherein the flow of water that exits the spray gun is both the working fluid of the pressure washer system and the cooling fluid of the pressure washer system.

17. A pressure washer system, comprising:

an internal combustion engine, comprising:

an engine block having a crankcase, wherein the crankcase is configured to contain a lubricant;

a crankshaft at least partially within the crankcase;

a cover that fastens to the engine block and seals the crankcase;

a water conduit extending through at least a portion of the crankcase and through at least a portion of the cover such that material continuously extends between the interior of the crankcase and a flow of water passing through the water conduit during operation of the pressure washer system; and a hose connector coupled to an end of the water conduit;

a water pump, comprising a pumping mechanism powered by the crankshaft; and a spray gun coupled to the water pump;

wherein the water conduit directs the flow of water to the pumping mechanism; and wherein the flow of water exits the pressure washer system via the spray gun.

18. The pressure washer system of claim 17, wherein the water pump is a positive displacement pump.

19. The pressure washer system of claim 18, wherein the water pump is at least one of an axial cam pump or a triplex water pump.

20. The pressure washer system of claim 19, wherein the water conduit extends around at least a portion of a cylinder portion of the internal combustion engine.

21. The pressure washer system of claim 19, wherein the engine block is formed from aluminum and the water conduit is formed from aluminum piping.

22. The pressure washer system of claim 17, wherein the flow of water that exits the spray gun is both the working fluid of the pressure washer system and the cooling fluid of the pressure washer system.

* * * * *